US007028957B1

(12) United States Patent
Larson

(10) Patent No.: US 7,028,957 B1
(45) Date of Patent: Apr. 18, 2006

(54) EASILY ASSEMBLED AND DISASSEMBLED TABLES

(76) Inventor: John Larson, P.O. Box 1197, Hamilton, MT (US) 59840

( * ) Notice: Subject to any disclaimer, the term of this patent is extended or adjusted under 35 U.S.C. 154(b) by 0 days.

(21) Appl. No.: 10/995,637

(22) Filed: Nov. 22, 2004

Related U.S. Application Data

(63) Continuation of application No. 10/315,372, filed on Dec. 9, 2002, now abandoned, which is a continuation-in-part of application No. 09/566,212, filed on May 5, 2000, now Pat. No. 6,491,269, and a continuation-in-part of application No. 09/348,618, filed on Jul. 6, 1999, which is a continuation-in-part of application No. 09/173,236, filed on Oct. 15, 1998, now Pat. No. 6,182,583.

(51) Int. Cl.
*F16M 11/26* (2006.01)
*A47B 9/00* (2006.01)

(52) U.S. Cl. ..... 248/188.5; 248/404; 108/147

(58) Field of Classification Search ..... 248/188.5, 248/161, 599, 563, 593, 594, 595, 600.622, 248/631, 188.2, 157, 404; 108/147, 150; 297/344.19

See application file for complete search history.

(56) References Cited

U.S. PATENT DOCUMENTS

| | | | | |
|---|---|---|---|---|
| 3,080,835 | A | 3/1963 | Guglielmi | |
| 3,285,207 | A | 11/1966 | Hagen | |
| 3,547,394 | A | 12/1970 | Wehner | |
| 3,664,274 | A | 5/1972 | Bustos | |
| 3,730,109 | A | 5/1973 | Kreizel et al. | |
| 3,788,587 | A | 1/1974 | Stemmler | |
| 3,921,952 | A | 11/1975 | Wirges | |
| 4,072,288 | A | 2/1978 | Wirges et al. | |
| 4,156,523 | A | 5/1979 | Bauer | |
| 4,240,619 | A | 12/1980 | Wirges et al. | |
| 4,283,033 | A | 8/1981 | Bauer | |
| 4,318,526 | A | 3/1982 | Werner | |
| 4,467,927 | A | 8/1984 | Nathan | |
| 4,692,057 | A | 9/1987 | Lauderbach | |
| 4,756,496 | A | 7/1988 | Hosan et al. | |
| 4,969,619 | A | 11/1990 | Bauer et al. | |
| 5,284,312 | A | 2/1994 | Dony | |
| 5,553,550 | A | 9/1996 | Doyle | |
| 5,740,997 | A * | 4/1998 | Van Wieran | 248/404 |
| 6,070,840 | A | 6/2000 | Kelley et al. | |
| 6,123,035 | A | 9/2000 | Pfister | |
| 6,224,155 | B1 | 5/2001 | DeKraker et al. | |
| 6,290,191 | B1 * | 9/2001 | Hendricks et al. | 248/188.1 |

* cited by examiner

*Primary Examiner*—Anita M. King

(57) ABSTRACT

Easy to assemble and disassemble tables have continuous frame members with at least two tapered sockets which support table legs. The continuous frame members are identical and thus can be used interchangeably as table bases and table top supports. The center of each taper within the continuous frame member is in the same position. Tapered sockets within each frame member insure that legs inserted into those sockets are parallel to one another. The parallelity of the table legs is further enhanced by inserting the other end of the table leg into a corresponding frame member in which the tapers are identically spaced. The tables are easy to assemble by inserting the tapered table legs into the "self-holding" tapered sockets in the frame members. Easy disassembly of the tables is facilitated by quick release mechanisms which press the end of the leg seated in the socket to displace the leg from the socket.

19 Claims, 22 Drawing Sheets

FIG. 6A
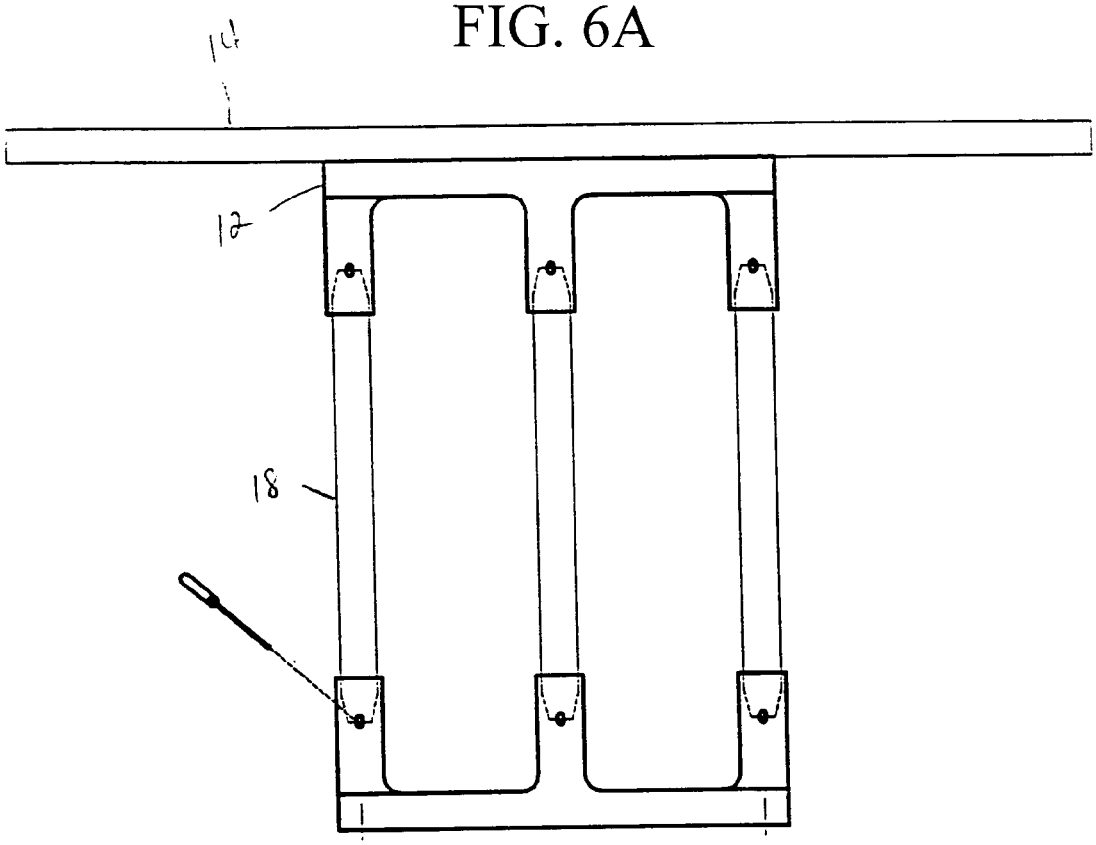
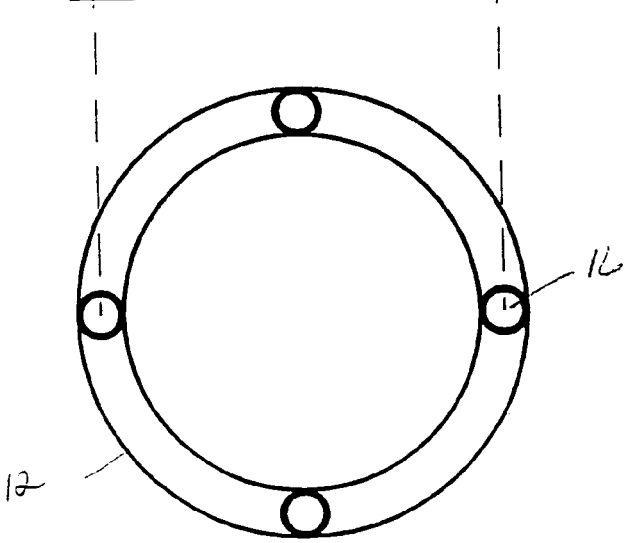
FIG. 6B

EASILY ASSEMBLED AND DISASSEMBLED TABLES

CROSS-REFERENCE TO RELATED APPLICATIONS

The subject application is a continuation of application Ser. No. 10/315,372 filed Dec. 9, 2002 now abandoned which was a continuation-in-part of 09/566,212, filed May 5, 2000 now U.S. Pat. No. 6,491,269 and also a continuation-in-part of co-pending application Ser. No. 09/378,618, filed Jul. 6, 1999; which was a continuation-in-part of application Ser. No. 09/173,236, filed Oct. 15, 1998, now U.S. Pat. No. 6,182,583. The disclosures of each of these documents are hereby incorporated by reference in their entireties, including all figures, tables and drawings.

BACKGROUND OF THE INVENTION

The rapidly changing landscape of the office environment has created a need for office furniture that is easily assembled and disassembled. Open concept offices that are configured into project teams are torn down and recreated with the completion of one project and the initiation of a new one or as a project changes focus. Likewise, school classrooms are fluid as study groups change for each subject.

Work tables that are easily to assemble and disassemble would facilitate such fluid environments. Currently, the assembly and disassembly of available tables requires the assistance of facilities operators who have the skills and tools to do the job. Tables with standardized and interchangeable parts that can be assembled quickly and disassembled without specialized tools would be valuable in today's work, and school, environments.

All patents, patent applications, provisional patent applications and publications referred to or cited herein, are incorporated by reference in their entirety to the extent they are not inconsistent with the explicit teachings of the specification.

SUMMARY

The invention involves tables that are easy to assemble and disassemble. The tables have a cast, continuous frame that can be used as a table base as well as a table top support. The frame has a plurality of tapered sockets for receiving table legs. The sockets cast or molded into the frame assure that table legs, including gas springs, when set into the frame remain parallel. Disassembly of the tables of the subject invention is facilitated by quick release mechanisms. These quick release mechanisms include a single opening in the socket in which a lever can be inserted near the end of the leg in the socket to pry the leg from the taper. Opposing openings in the taper provide a double fulcrum quick release mechanism. Additionally, the leg can be released from the taper by rotating a rod with a cam lobe which is disposed beneath the leg.

BRIEF DESCRIPTION OF THE DRAWINGS

FIG. 6A show a side elevational view of another particularly preferred embodiment of the easily assembled and disassembled tables of the subject invention.

FIG. 6B shows a top plan view of another preferred embodiment of a frame member of the easily assembled and disassembled table of the subject invention.

DETAILED DESCRIPTION OF THE INVENTION

The subject invention involves easy to assemble tables. The subject tables are likewise easy to disassemble.

Figure 1A:
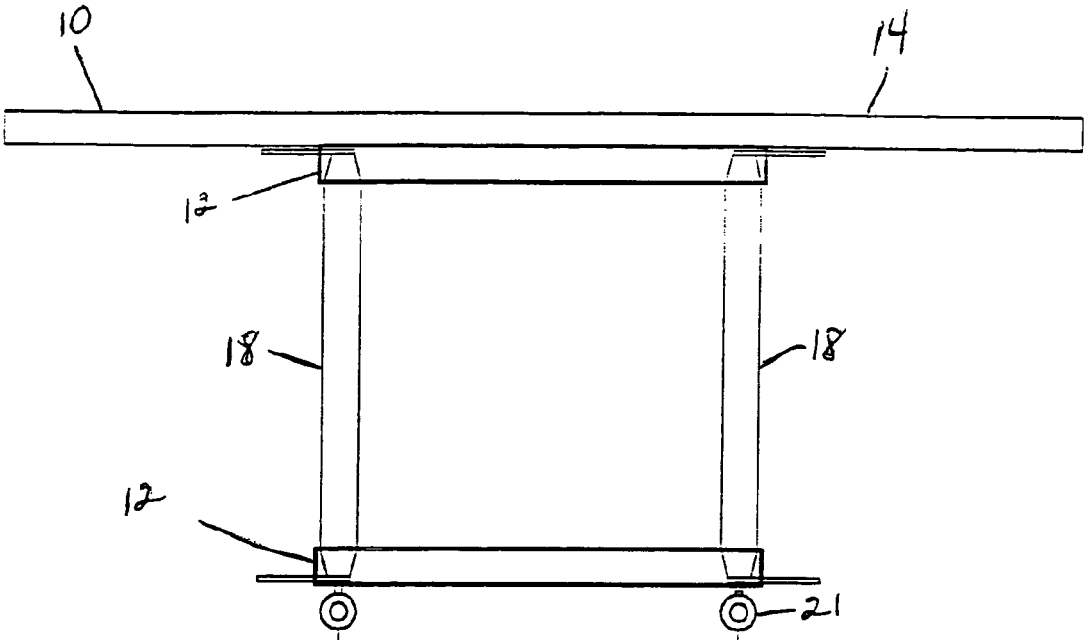
FIG. 1A shows a side elevational view of a preferred embodiment of the easily assembled and disassembled table of the subject invention.
Figure 1B:
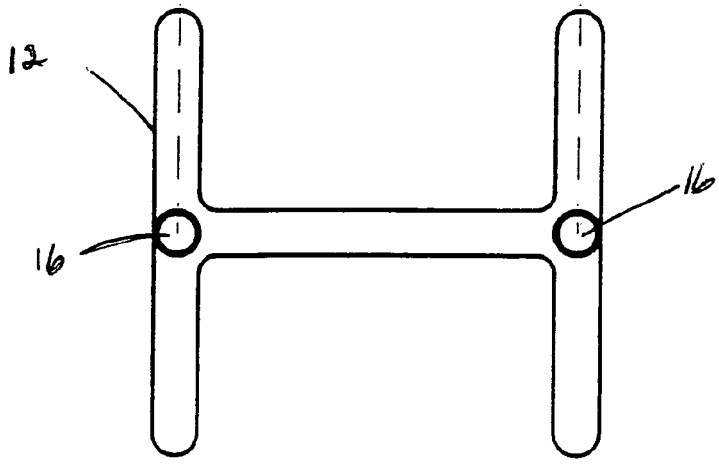
FIG. 1B shows a top plan view of a preferred embodiment of a frame member of the easily assembled and disassembled table of the subject invention.
Figure 11:
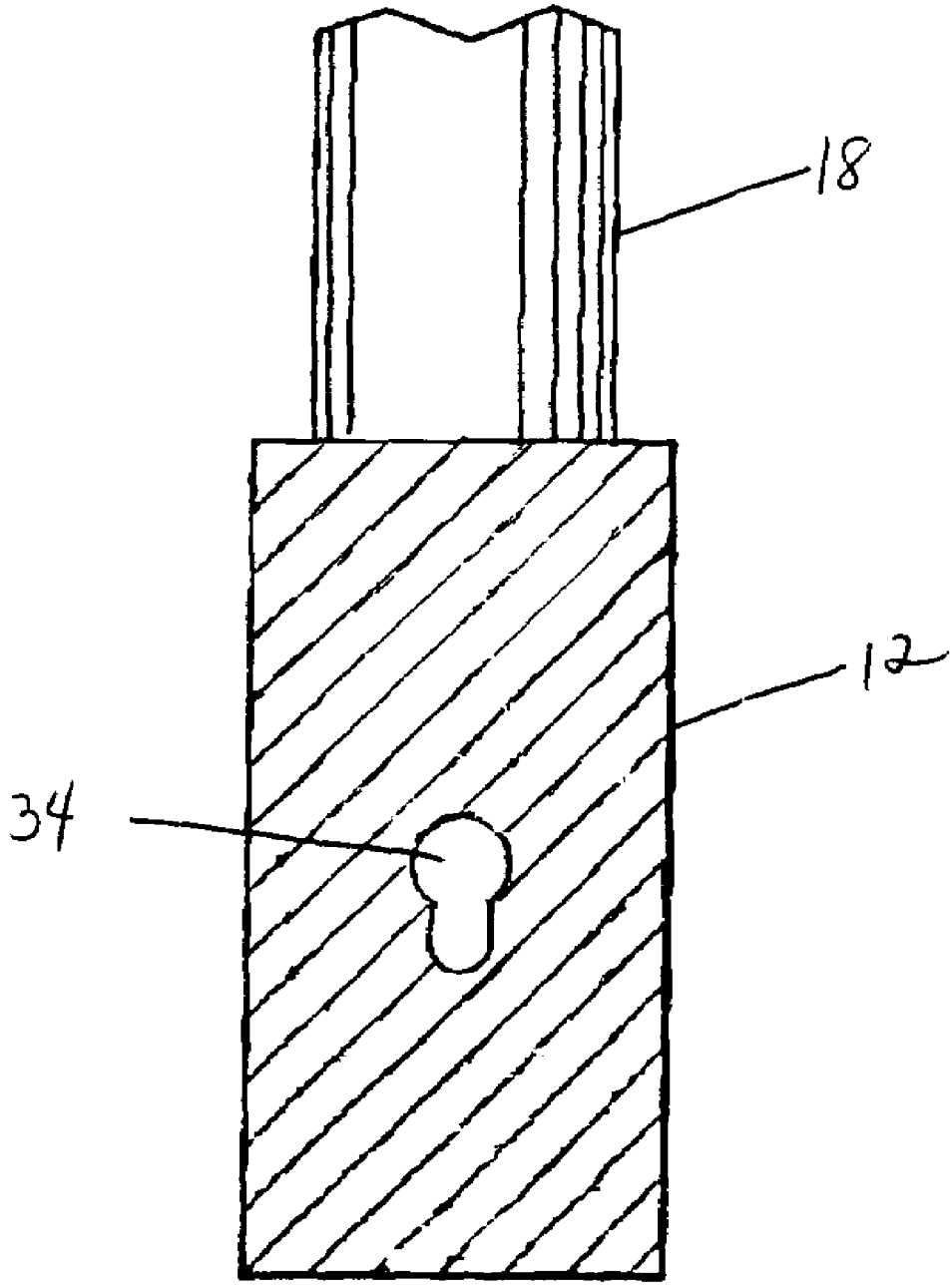
FIG. 11 shows a front elevational view of a preferred embodiment of a mechanism facilitating assembly of a quick release mechanism shown in FIG. 10.

A preferred embodiment of a table of the subject invention is shown generally at 10 in FIG. 1A. A continuous frame member 12 (FIG. 11B) serves as both the table base and a support for the table top 14. Thus the table of the subject invention achieves a "standardization of parts" which positively affects the cost and complexity of the subject table. The frame has a plurality of tapered sockets 16 to receive table legs 18.

The frame 12 of the tables of the subject invention is a continuous piece having at least two tapered sockets. The frame is preferably cast, for example from aluminum or steel. The frame can also be made of a durable, molded plastic.

The tapered sockets 16 in the frame member are standard tapers known to those skilled in the art. These "self-holding" tapers have an angle of taper that varies only a few degrees, thus, the shank or leg of the table placed in the taper is seated so firmly in the socket that there is considerable frictional resistance to any force which tends to rotate or withdraw the leg relative to the socket. The taper is "self-holding." Examples of a "self-holding" taper useful according to the subject invention, include but are not limited to, Morse, Brown & Sharpe, Jarno and American National tapers. The methods by which these tapers can be cast or molded into the continuous frame are known to those skilled in the art.

The tables of the subject invention are easy to assemble requiring no tools. The leg ends which are configured to correspond to the tapered socket are simply inserted into the sockets. Advantageously, sockets which are cast or molded into the frame assure that the table legs placed into those sockets are parallel to one another and remain parallel to one another.

Figure 2A:
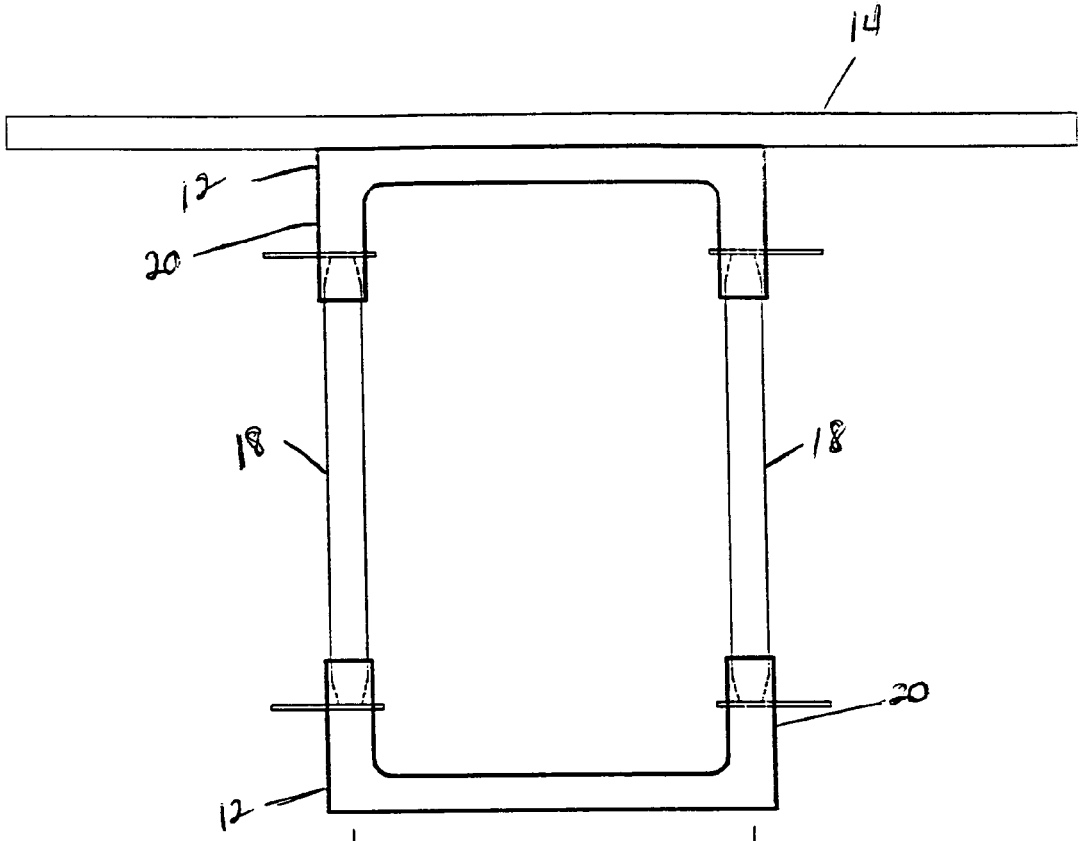
FIG. 2A shows a side elevational view of another preferred embodiment of the easily assembled and disassembled tables of the subject invention.
Figure 2B:
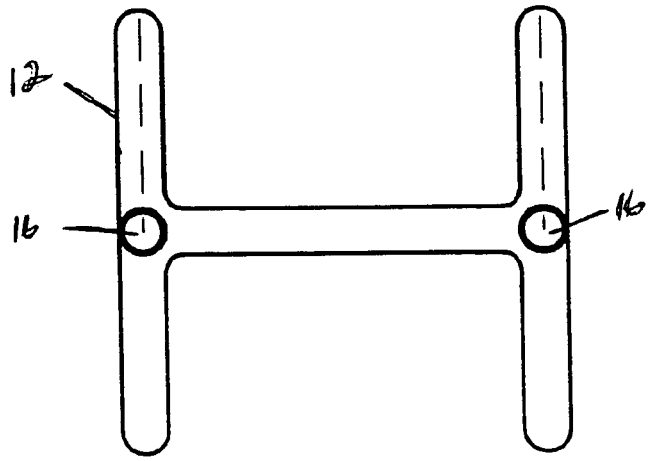
FIG. 2B shows a top plan view of another preferred embodiment of a frame member of the easily assembled and disassembled table of the subject invention.

The frame can be adapted to address the needs of any situation. For example, the frame used as a table base in FIG. 1A has been constructed to receive casters 21 so the assembled table can be readily moved. The tapered sockets on the frame members of FIG. 2A are raised above the frame member on extensions 20 allowing assembly of a taller table. Applicant notes, the length of the legs could also be varied to alter table height.

Figure 3:
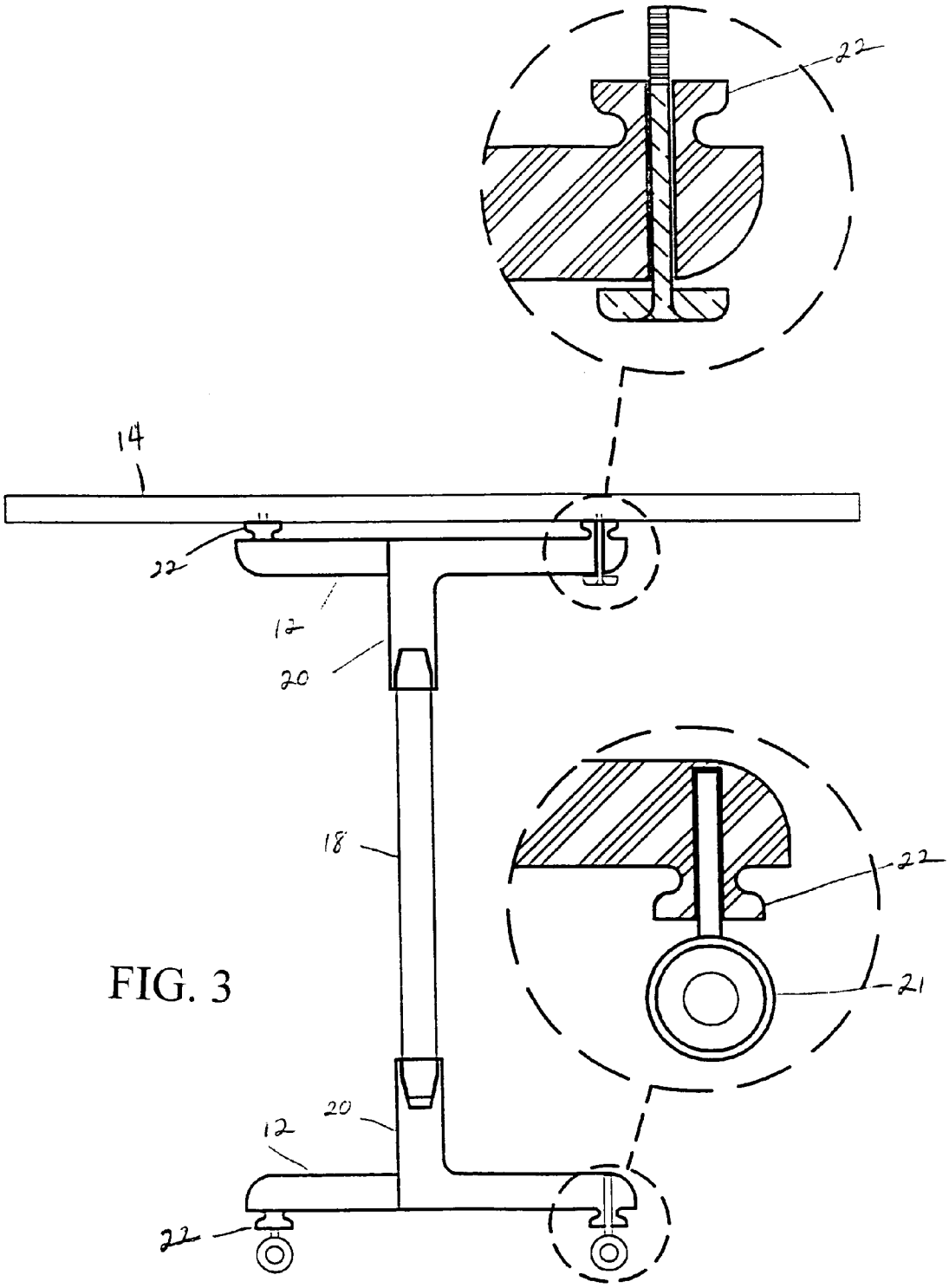
FIG. 3 shows a particularly preferred embodiment of the table base/table top support of the tables of the subject invention.

The frame member can also be cast to include glides 22 as shown in FIG. 3. Glides cast into the frame can be bored to receive casters. Boring into the frame member and nearly to the opposite edge of the frame allows the frame member to be easily adapted to receive a bolt or fastener when the frame is used as a table top support to secure the table top to the frame. The glides can also serve as feet on a frame used as a table base and frictional contact surfaces for a table top when used as a table top support.

Figure 4:
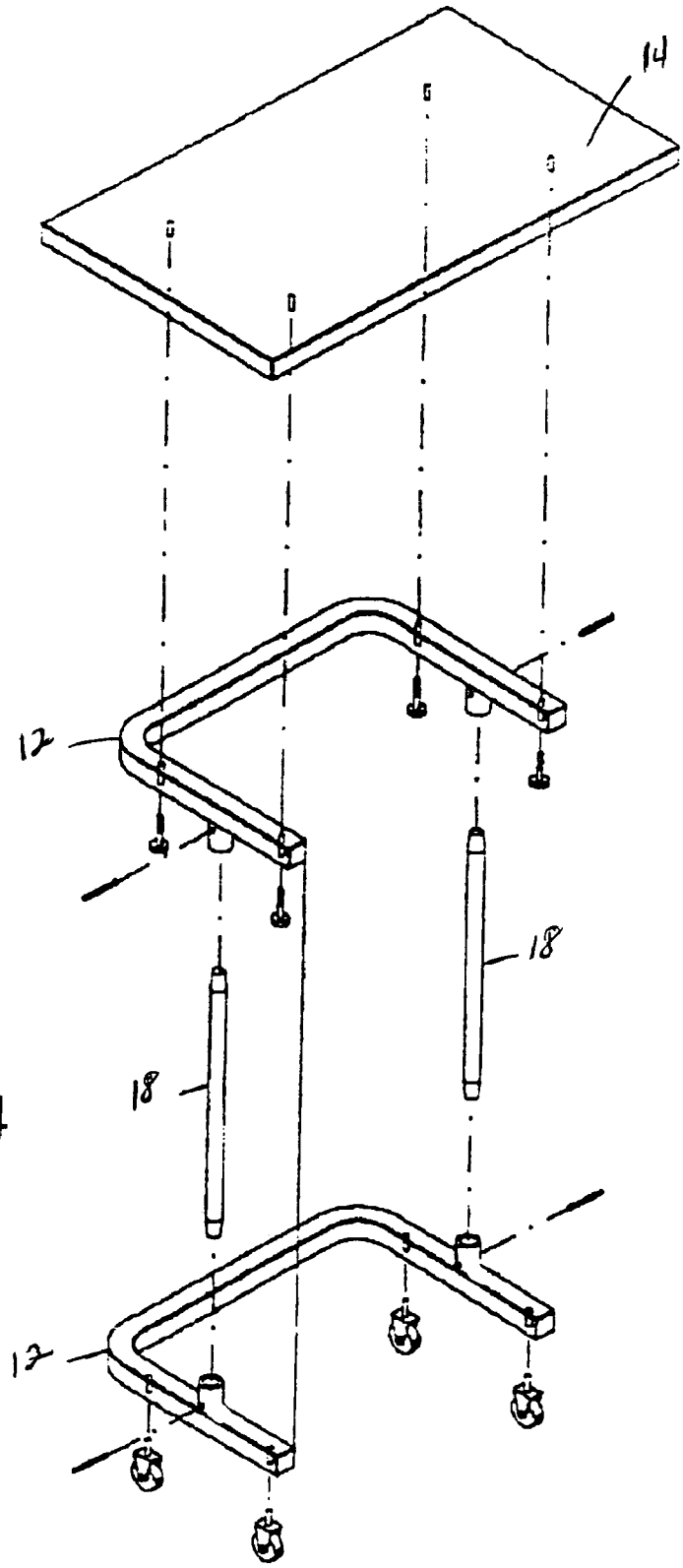
FIG. 4 shows an exploded view of another preferred embodiment of the easily assembled and disassembled tables of the subject invention.
Figures 5A, 5B:
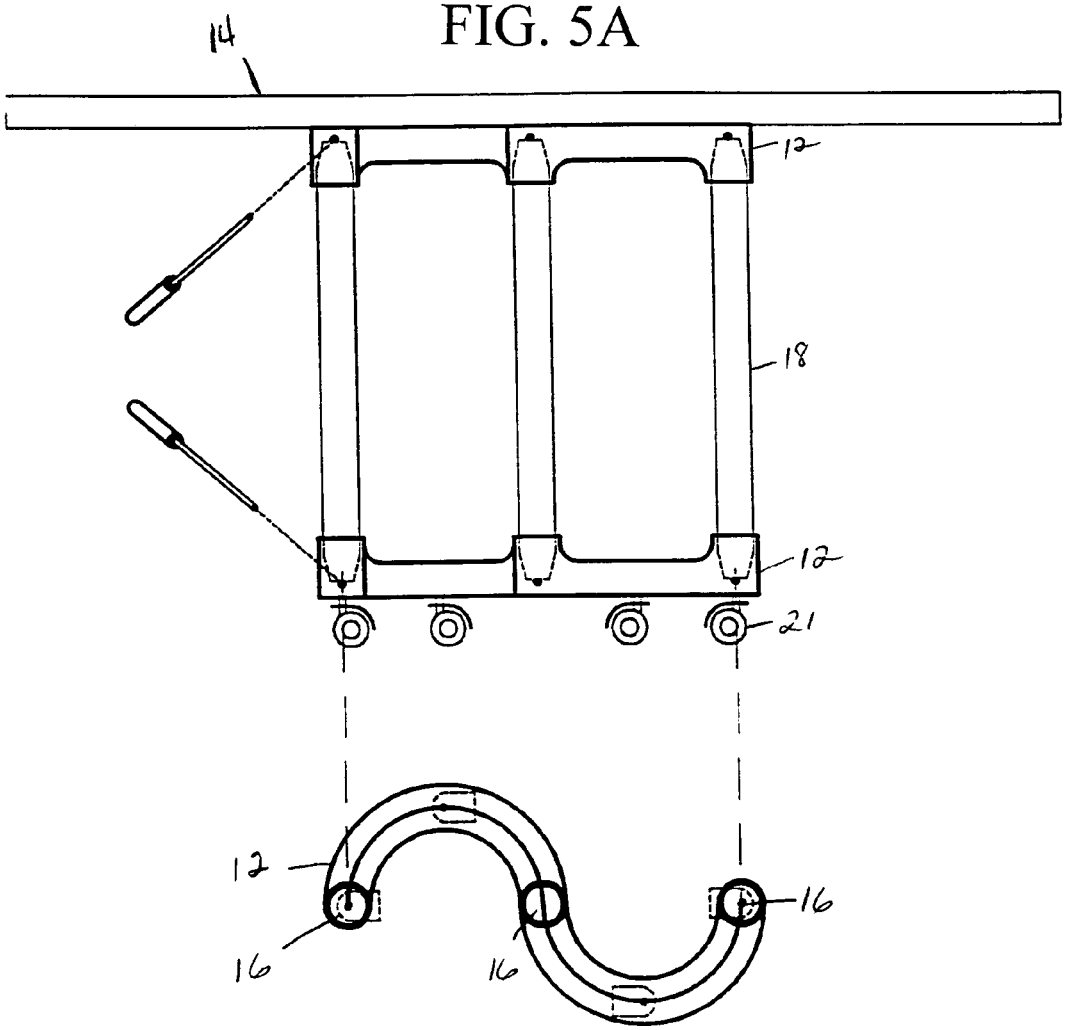
FIG. 5A shows a side elevational view of another particularly preferred embodiment of the easily assembled and disassembled tables of the subject invention.
FIG. 5B shows a top plan view of another preferred embodiment of a frame member of the easily assembled and disassembled table of the subject invention.
Figure 7A:
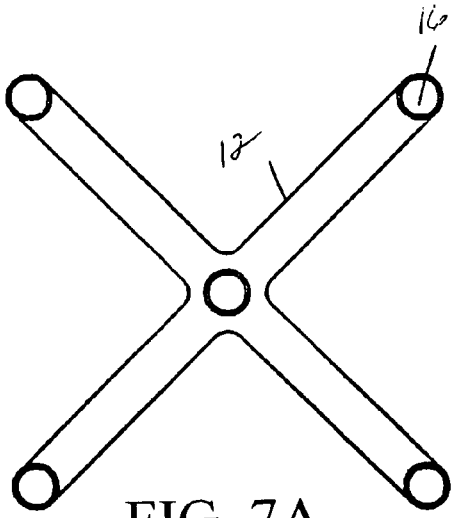
FIGS. 7 A–L show other particularly preferred embodiments of the frame members of the easily assembled and disassembled tables of the subject invention.
Figure 7D:
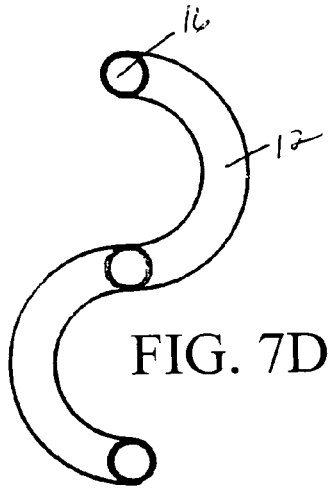
Figure 7B:
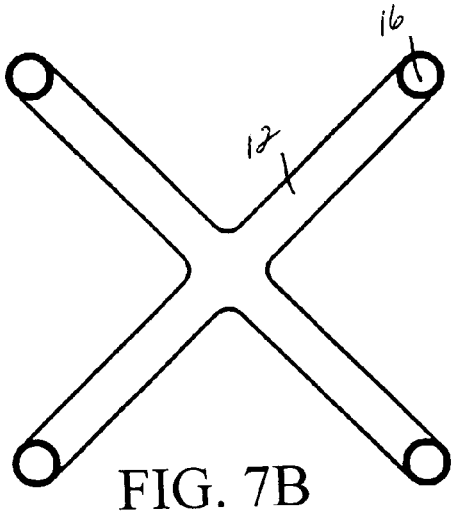
Figure 7E:
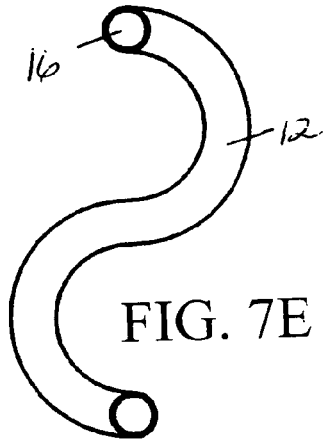
Figure 7C:
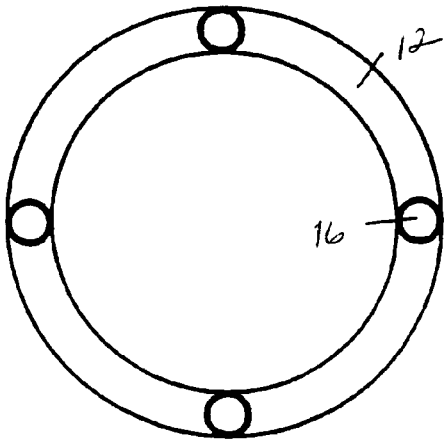
Figure 7F:
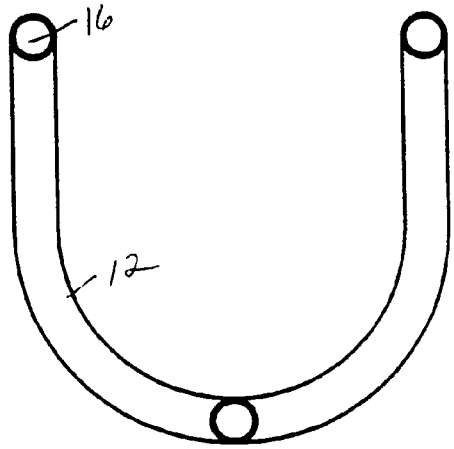
Figure 7G:
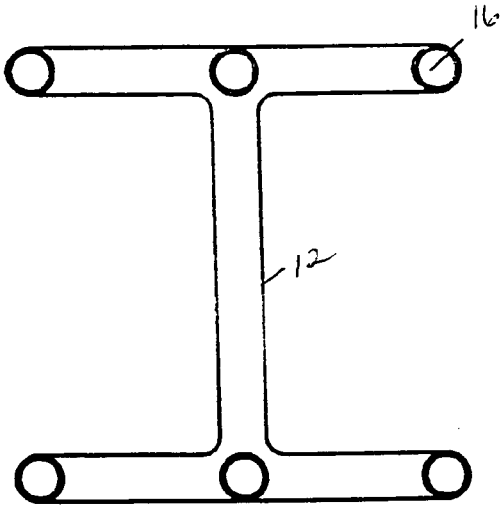
Figure 7J:
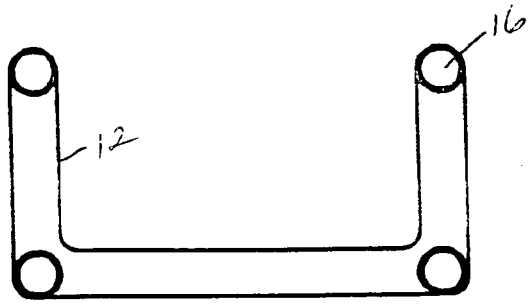
Figure 7H:
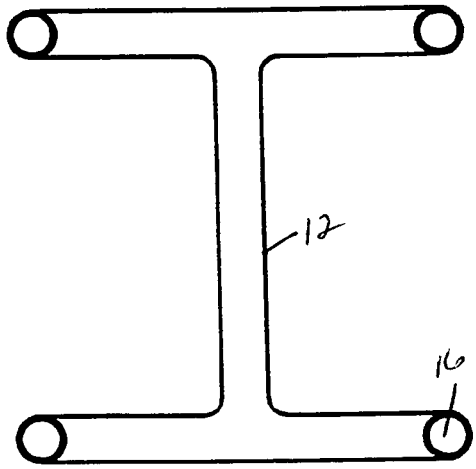
Figure 7K:
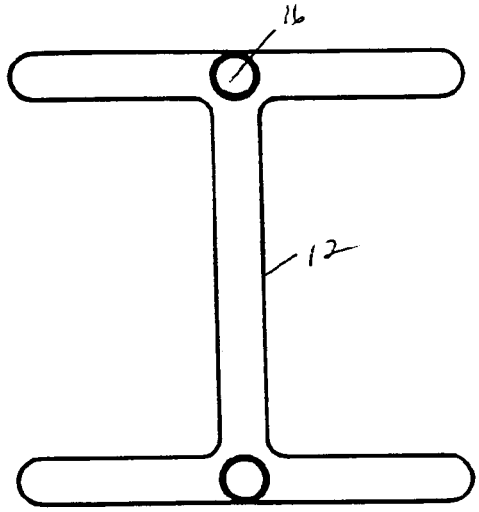
Figure 7I:
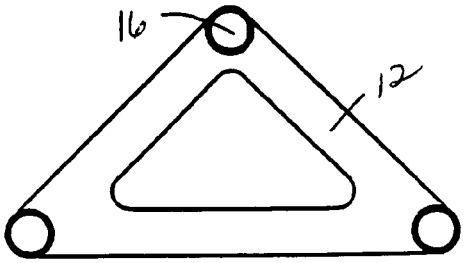
Figure 7L:
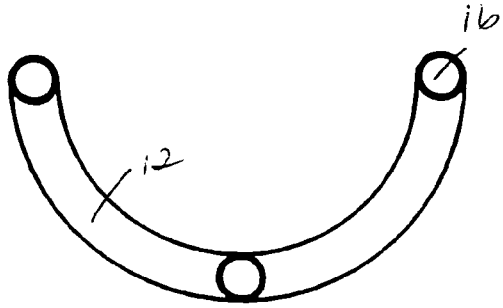

The continuous frame having at least two tapered sockets on the easily assembled tables of the subject invention can be any configuration. FIG. 4 shows a frame which is U-shaped and allows access to the table by someone sitting in a wheelchair. FIGS. 5A and 5B show a table with S-shaped frame members. Such frame members allow for two individuals to access and share the table on opposite sides of the table. FIGS. 6A and 6B show an embodiment of the table of the subject invention where the frame members are round and have four tapered sockets. The round frame members can attractively support a round table top. It is important to note however, that each frame member shape disclosed can support table tops that are a variety of shapes and sizes. FIGS. 7A–L show other configurations of the multi-socketed frames of the tables of the subject invention. These continuous, cast or molded, frame members insure that each frame is identical to the next. Thus, a table assembled using these frame members have-parallel and true legs.

Figure 8A:
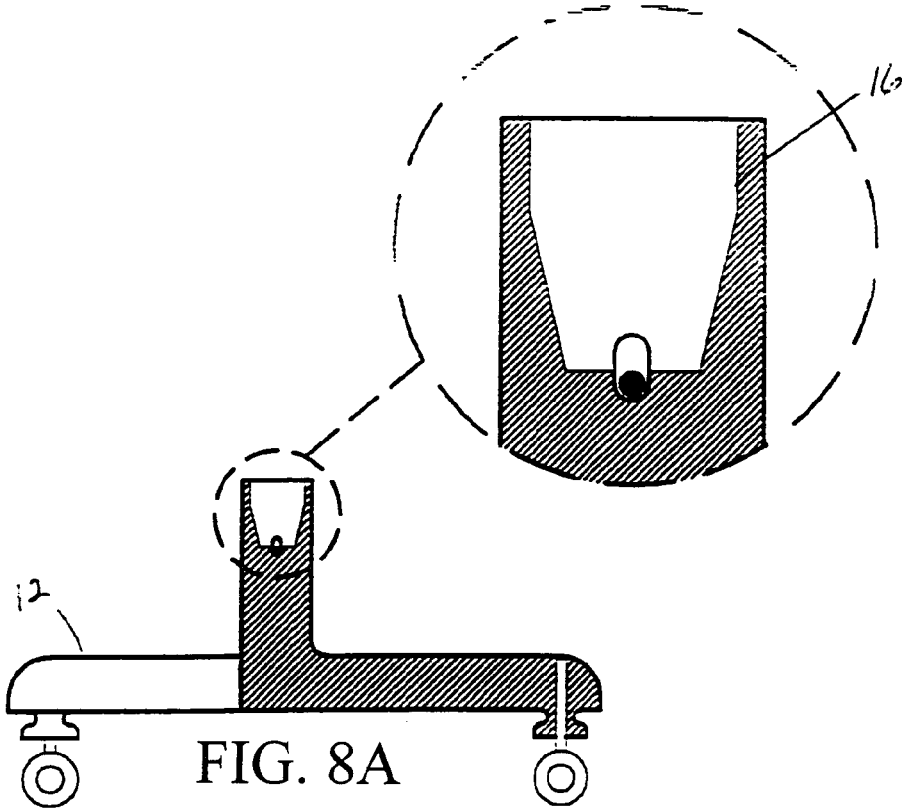
FIG. 8A shows a front elevational view in partial cross-section of a preferred embodiment of a quick release mechanism applicable to the easily assembled and disassembled tables of the subject invention.
Figure 8B:
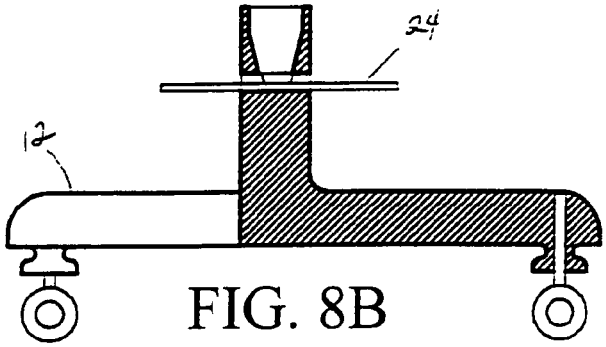
FIG. 8B shows a side elevational view in partial cross-section of a preferred embodiment of a quick release mechanism applicable to the easily assembled and disassembled tables of the subject invention.
Figure 9:
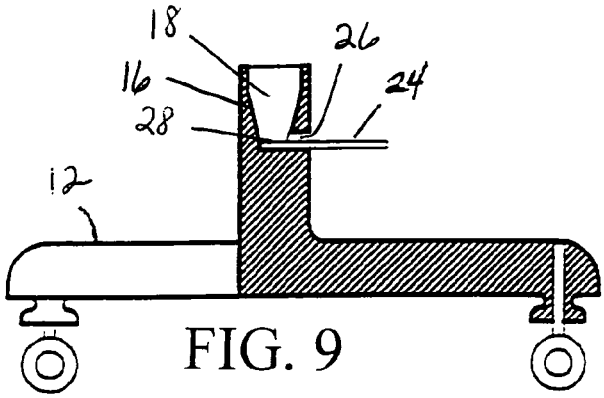
FIG. 9 shows a side elevational view in partial cross-section of another preferred embodiment of a quick release mechanism applicable to the easily assembled and disassembled tables of the subject invention.

The tables of the subject invention can be as easy to disassemble as they are to assemble. The tables are easily assembled by inserting tapered table legs into complimentary tapered sockets in the frame member. A current industry standard, for example, utililizes a Morse 3 taper of 28, 45 or 50 mm in a chair base to capture a tapered gas spring stand tube. To facilitate easy disassembly of the tables of the subject invention, the tables can include quick release mechanisms which dislodge the table legs from the tapered sockets in the frame members. A quick release mechanism includes a means for pressing on the end of the leg to separate the leg from the socket. Preferred embodiments of the quick release mechanisms applicable to the table is the subject invention are shown in FIGS. 8A & B and FIG. 9. FIG. 9 shows a quick release mechanism which employs a rod 24 pivoting about a single fulcrum on the frame member to pry the leg 18 from the socket 16. The rod 24 is inserted in an opening 26 in the frame member just below the end 28 of the leg within the socket. Moving the rod either up or down applies pressure to the end of the leg and dislodges the leg from the socket.

Another preferred embodiment of the quick release mechanism applicable to the table of the subject invention is shown in FIGS. 8A & B. In this embodiment, two fulcrums are provided on which a rod can pivot in order to contact and displace the leg from the socket. Two openings in the frame allow the rod to proceed through the frame so that it can be manipulated on either side. At least one of the two openings must be enlarged to allow the rod to move within the opening (FIG. 8A). Moving the rod either up or down presses on the end 28 of the leg, separating the leg from the socket.

Figure 10A:
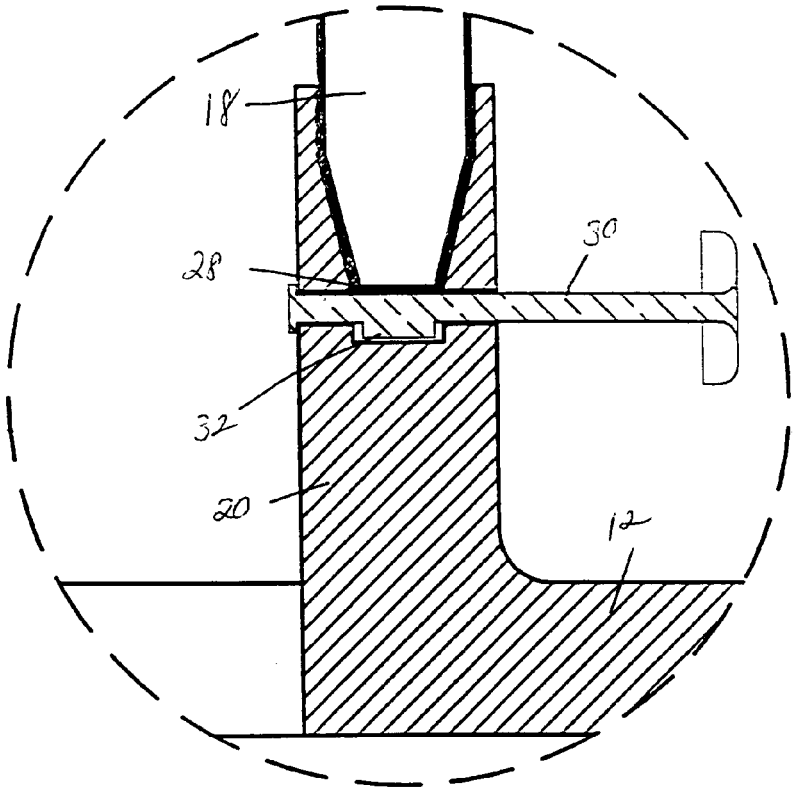
FIG. 10A shows a side elevational view in cross-section of another preferred embodiment of a quick release mechanism applicable to the easily assembled and disassembled tables of the subject invention.
Figure 10B:
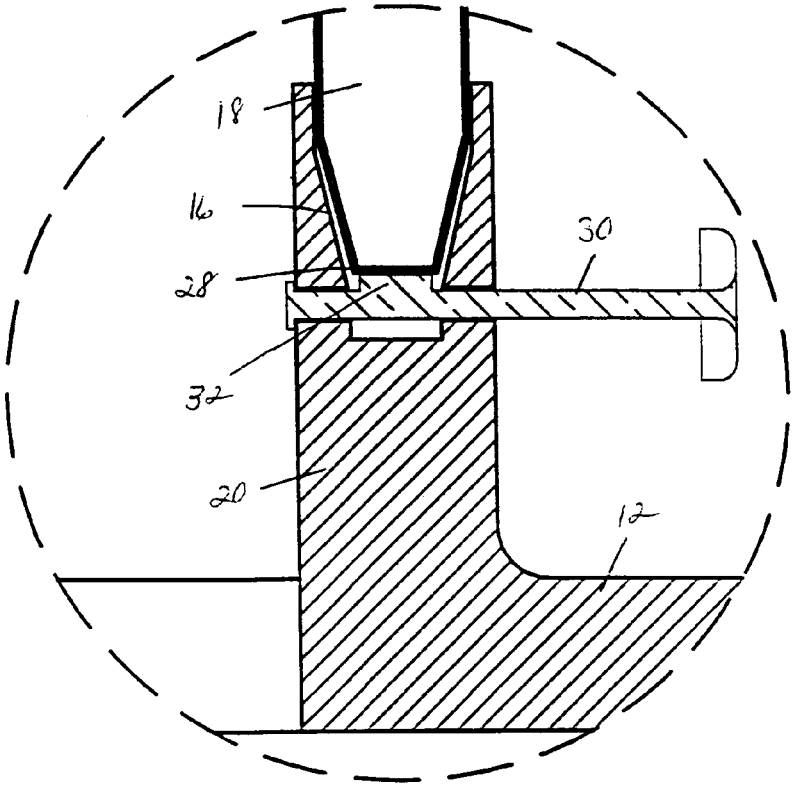
FIG. 10B shows a side elevational view in cross-section of another preferred embodiment of a quick release mechanism applicable to the easily assembled and disassembled tables of the subject invention.
Figure 12A:
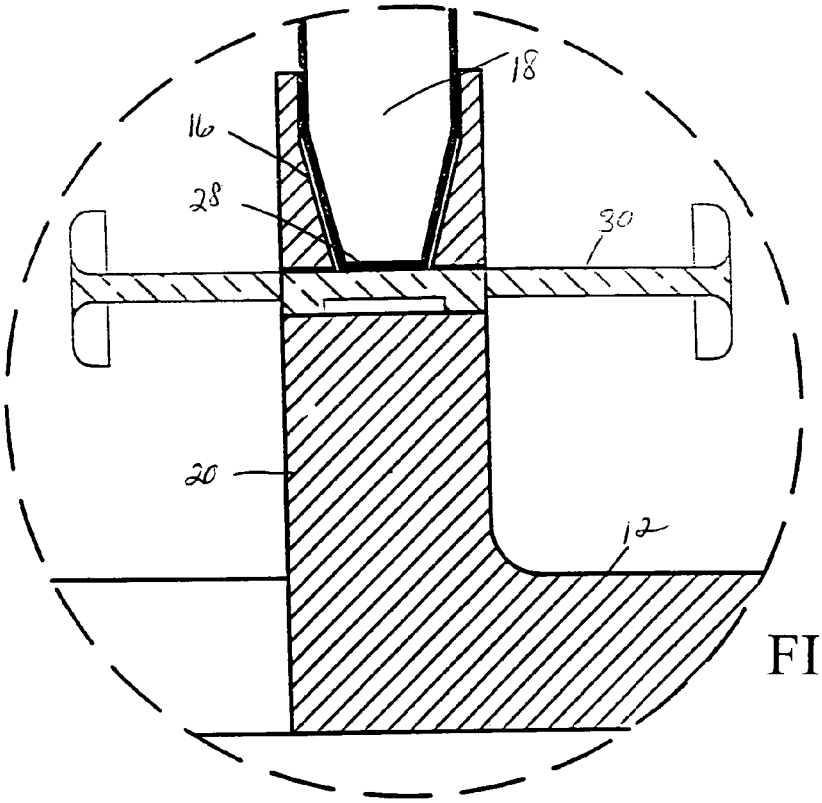
FIG. 12A shows a side elevational view in cross-section of another preferred embodiment of a quick release mechanism applicable to the easily assembled and disassembled tables of the subject invention.
Figure 12B:
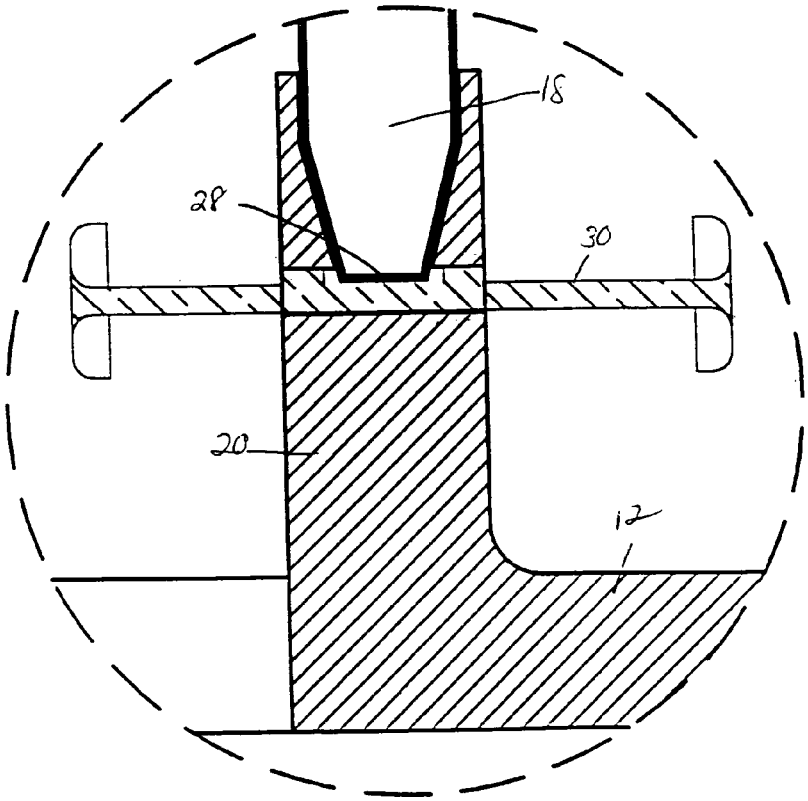
FIG. 12B shows a side elevational view in cross-section of another preferred embodiment of a quick release mechanism applicable to the easily assembled and disassembled tables of the subject invention.

Another preferred embodiment of the quick release mechanism applicable to the table of the subject invention is shown in FIGS. 10A & B. FIGS. 10A and 10B show a rod inserted below the end 28 of the table leg 18. The rod has a cam lobe. Rotating the rod with the cam lobe 30 causes the lobe 32 to press the end 28 of the leg to separate it from the socket 16. The rod with cam lobe 30 can be inserted into the frame through a keyhole opening 34 like the one shown in FIG. 11. FIGS. 12A & B show an alternative embodiment of a rod with a cam lobe 30 in which the leg rests in a cut-out in the rod and is dislodged from the socket as the rod is rotated and the leg is displaced from the cut-out. Cam rods as those shown in FIGS. 10A, 10B, 12A, and 12B can be configured to be operated from both sides of the frame member.

Figure 13:
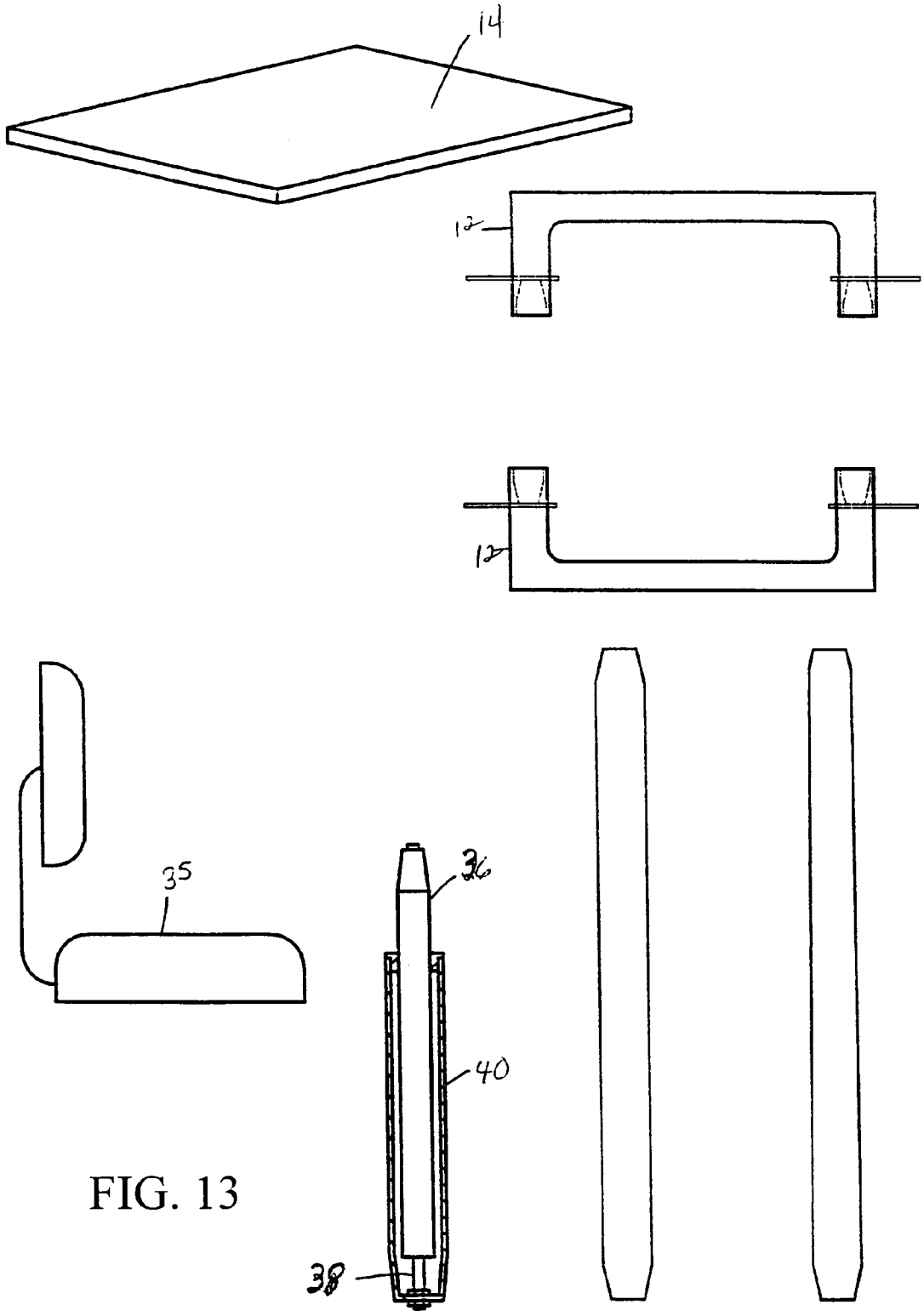
FIG. 13 shows an exploded view of a preferred embodiment of the easily assembled and disassembled table of the subject invention and shows a chair seat and alternative legs.

FIG. 13 illustrates that the frame members of the table of the subject invention, which serve as both a table base and a table top support, can also serve as a chair base and furniture component support, for example, a chair seat support for a chair seat 35. Further, the FIG. 13 shows that the table legs can be gas springs opposed to the tapered tubes already shown. Using gas springs as legs makes the table height adjustable. Gas springs comprise a piston 38 moving in and out of a tapered cylinder 36. The piston 38 is secured to a tapered stand tube 40. A table with legs 18 that are gas springs would require that the frame member serving as a table base have different sized tapered sockets than the frame member serving as a table top support to accommodate the different tapers of the cylinder 36 and stand tube 38. One skilled in the art could anticipate, however, means to equalize the tapers such as perhaps a cap over the cylinder wherein the cap had a taper equaling the taper of the stand tube. Alternatively, the tube could be elongated and further tapered to equal the smaller taper of the cylinder. The cast, continuous frame members of the tables of the subject invention are particularly advantageous in that the tapered sockets are precise insuring that the gas springs set into them will stand and remain parallel. Parallelity of two or more gas springs is imperative to having a table on which the gas springs do not bind. A further advantage of the continuous frame members of the tables of the subject invention is that each frame is identical to the next. Thus, frame member pieces are readily interchangeable. Additionally, the center of each taper is in the same position on each frame member. Thus, table legs set into the tapers of a table base and the tapers of a table base and the tapers of a table top support are readily aligned and held parallel to one another. This is particularly advantageous when the legs are gas springs and parallelity is imperative to prevent binding.

Figure 14A:
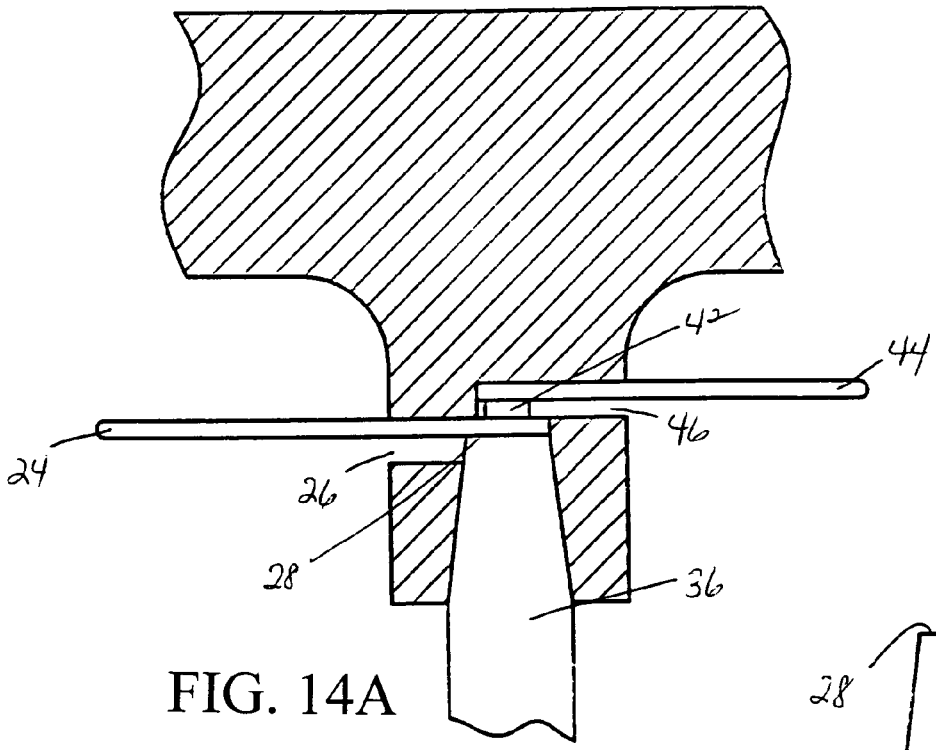
FIG. 14A shows a side elevational view in cross-section of another preferred embodiment of a quick release mechanism applicable to the easily assembled and disassembled tables of the subject invention.
Figure 14C:
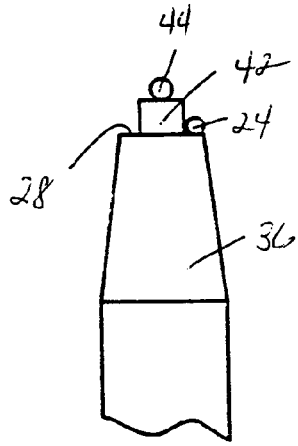
FIG. 14C shows a front elevational view of the isolated gas spring with actuation button, actuation lever and quick release rod of the quick release mechanism shown in FIGS. 14A & 14B.
Figure 14B:
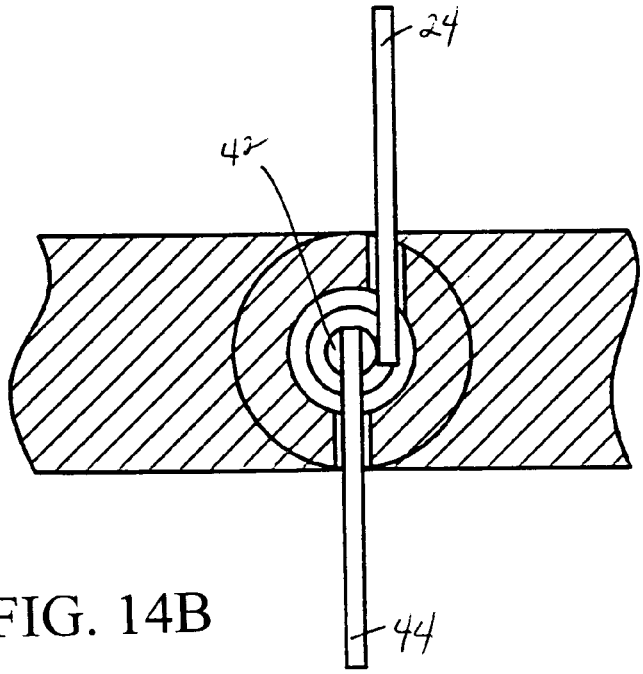
FIG. 14B shows a top plan view of the quick release mechanism shown in FIG. 14A.

Locking gas springs have an actuation button 42 at the end of the cylinder 36 to actuate the spring. Moving the button 42 affects a valve allowing movement of the gas within the spring. The spring is thus unlocked and the piston can be moved into or out of the cylinder. When the valve is closed, gas is not allowed to move within the spring and the piston is locked in one position relative to the cylinder. FIGS. 14A–14C show a quick release mechanism which will not effect the actuation button 42 of the gas spring. A rod 24 inserted in an opening 26 lies beside button 42. Pivoting this rod presses on the end 28 of the leg, separating the leg from the socket. A separate actuation mechanism to actuate the gas spring comprises an actuation lever 44 in an opening 46. As the actuation lever pivots in the opening it contacts the actuation button, locking or unlocking the gas spring.

Figure 15C:
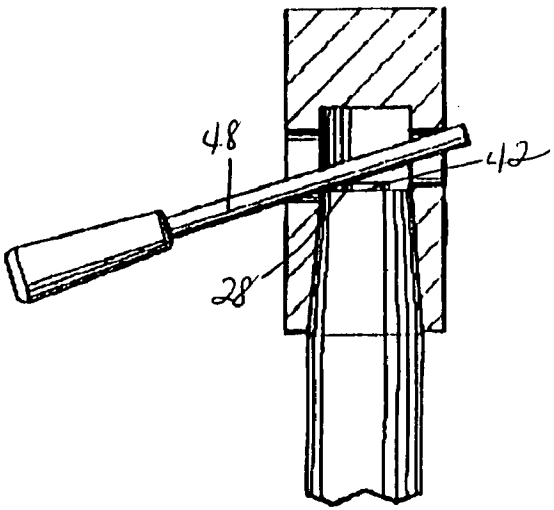
FIGS. 15A, 15B & 15C show side elevational views in cross-section of another preferred embodiment of a quick release mechanism applicable to the easily assembled and disassembled tables of the subject invention.
Figure 15B:
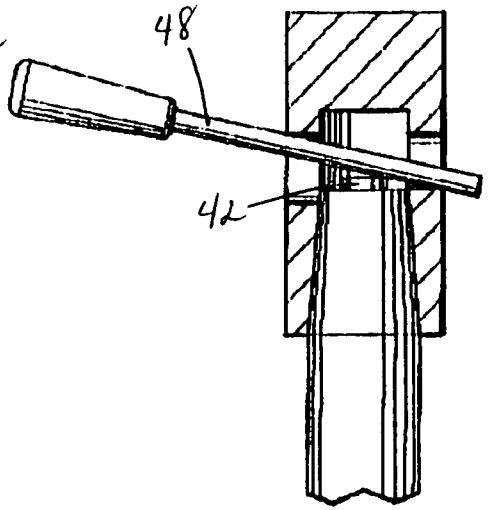
Figure 15A:
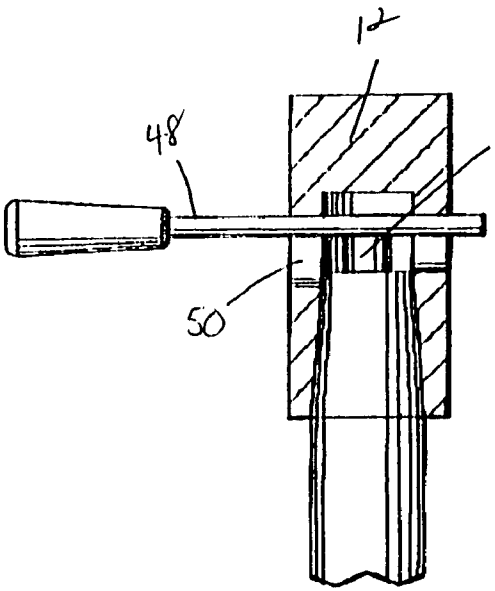
Figure 16:
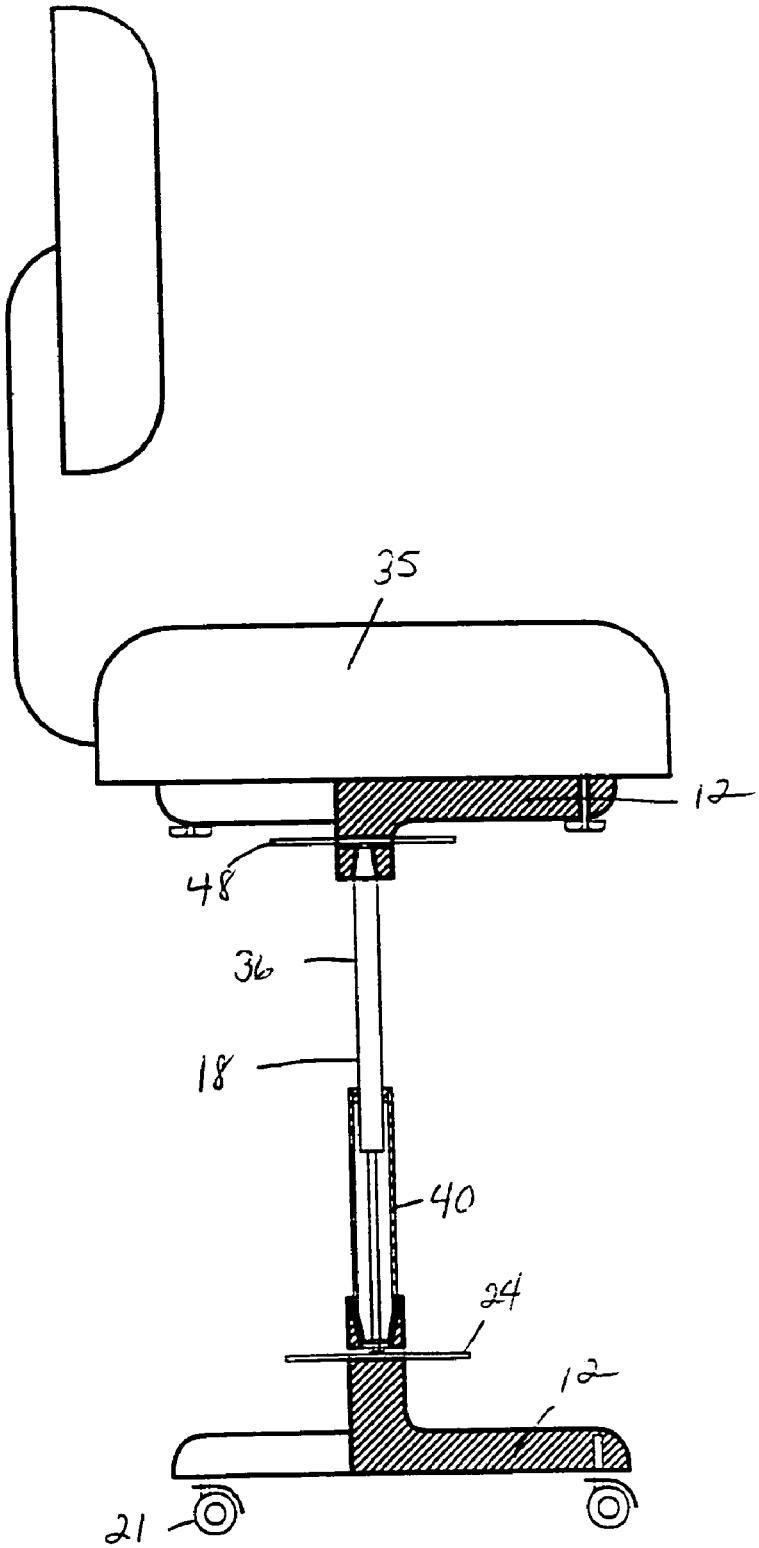
FIG. 16 shows a side elevational view of a preferred embodiment of a chair with double fulcrum quick release mechanism.

FIGS. 15A, B and C show a quick release mechanism to separate a leg from a tapered socket that also serves as an actuation mechanism of the gas spring. A lever 48 is inserted into openings 50 in the frame member which positions the lever above the actuation button 42. Both openings 50 must be enlarged to permit movement of the lever within the opening. One of the openings is larger than the other to permit extended travel so that the lever can contact and move the cylinder. As shown in FIG. 15B, moving the lever up causes the lever to contact the actuation button and actuate the gas spring. Moving the lever down will likewise cause the lever to contact the button and actuate the gas spring, however, in the configuration shown, pressing the lever down further also causes the lever to press on the end 28 of the leg and displace the gas spring cylinder from the socket (FIG. 15C). FIG. 16 shows a chair utilizing a similar quick release mechanism wherein the lever 48 can be used to actuate the gas spring and displace the spring leg from its socket. Lever 48 has dual fulcrums available to assist in separating the cylinder 36 of the gas spring leg 18 from the tapered socket 16 in the frame member 12. The stand tube 40 is likewise released from the tapered socket in the chair base by pivoting a rod 24 about a fulcrum wherein the rod presses against the end of the stand tube.

Figure 17A:
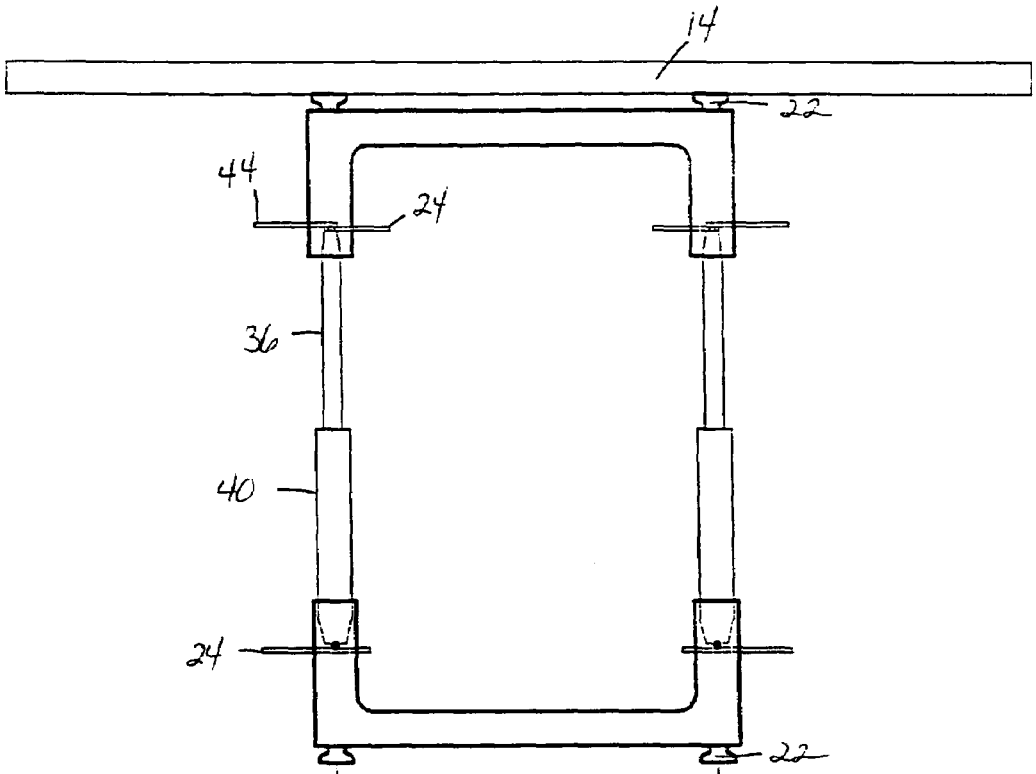
FIG. 17A shows a side elevational view of another preferred embodiment of an easily assembled and disassembled table of the subject invention with gas spring legs.
Figure 17B:
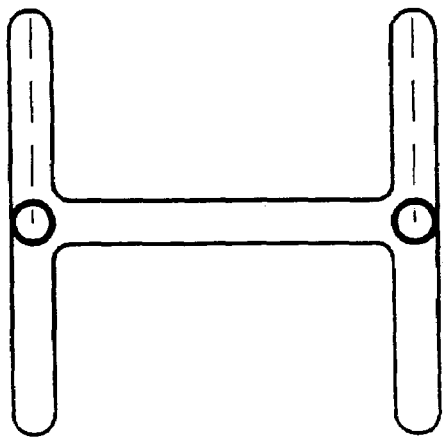
FIG. 17B shows a top plan view of another preferred embodiment of a frame member of the easily assembled and disassembled table of the subject invention.
Figure 18A:
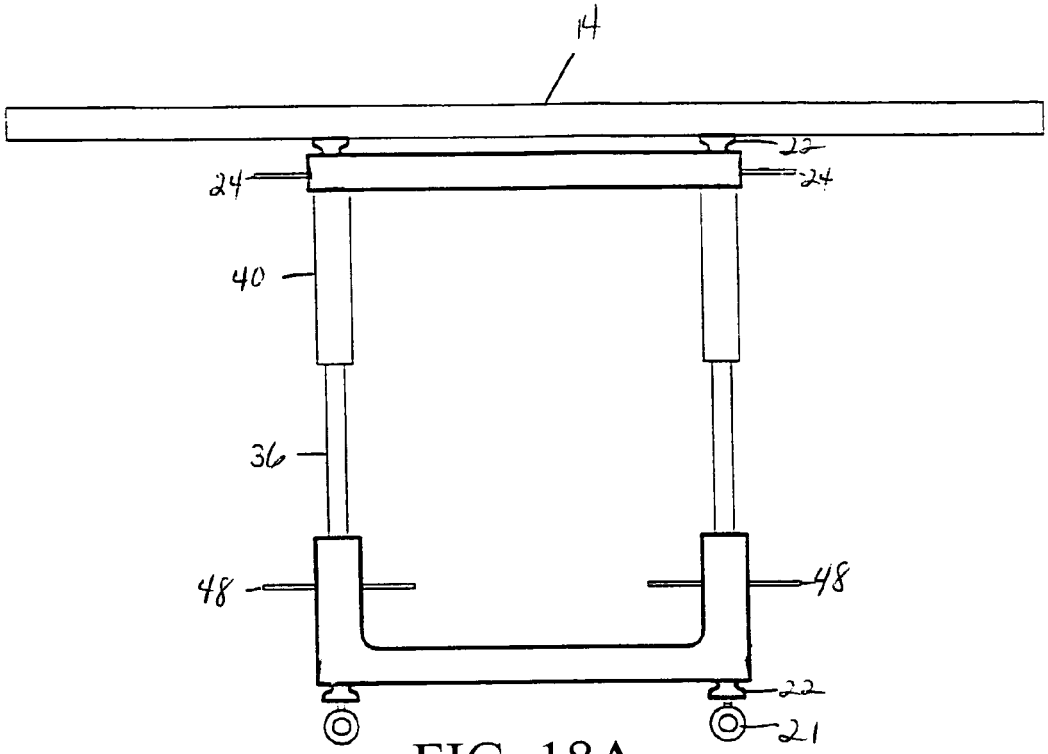
FIG. 18A shows a side elevational view of another preferred embodiment of an easily assembled and disassembled table of the subject invention with gas spring legs.
Figure 18B:
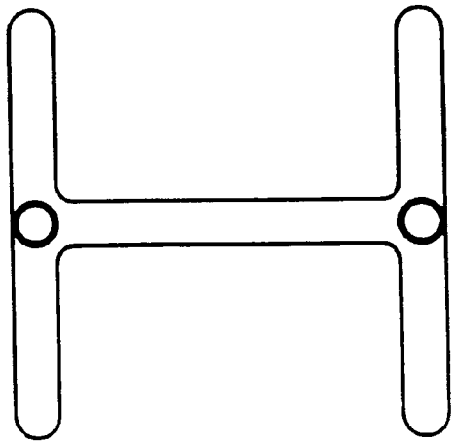
FIG. 18B shows a top plan view of another preferred embodiment of a frame member of the easily assembled and disassembled table of the subject invention.

FIGS. 17A, 17B, 18A and 18B show preferred embodiments of the easily assembled and disassembled tables of the subject invention with gas spring legs. FIGS. 17A and 17B show a table with the stand tube of the gas spring inserted into the tapered socket of the frame member serving as the table base. FIGS. 18A and 18B show a table with the stand tube of the gas spring inserted into the taper socket of the frame member serving as a table top support.

Figure 19A:
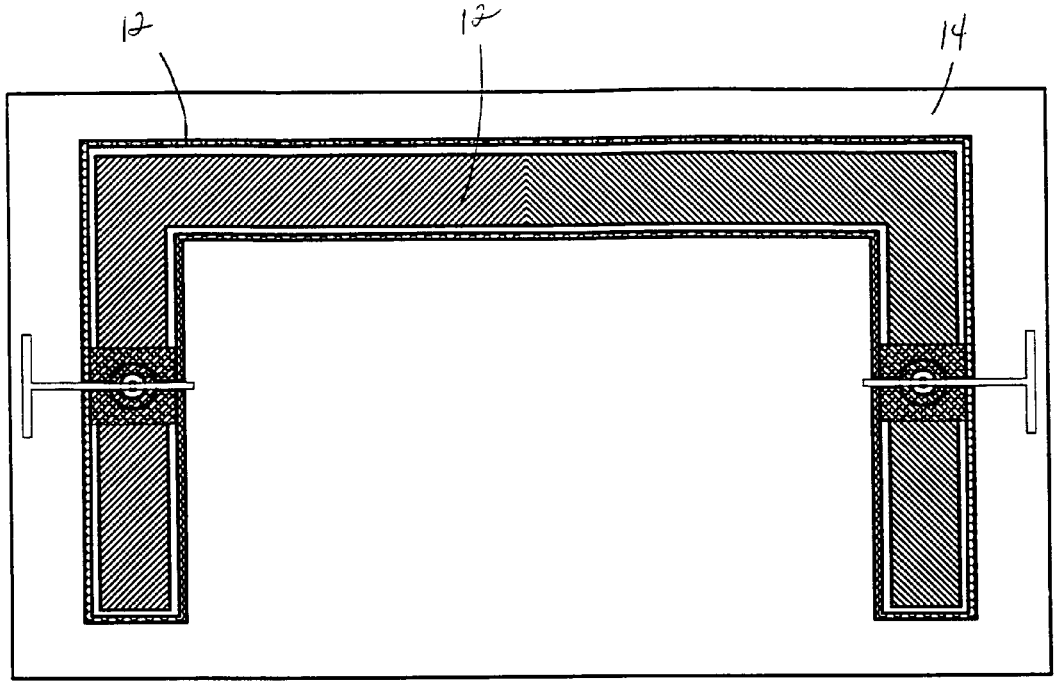
FIG. 19A shows a top plan view of another preferred embodiment of the easily assembled and disassembled tables of the subject invention.
Figure 19B:
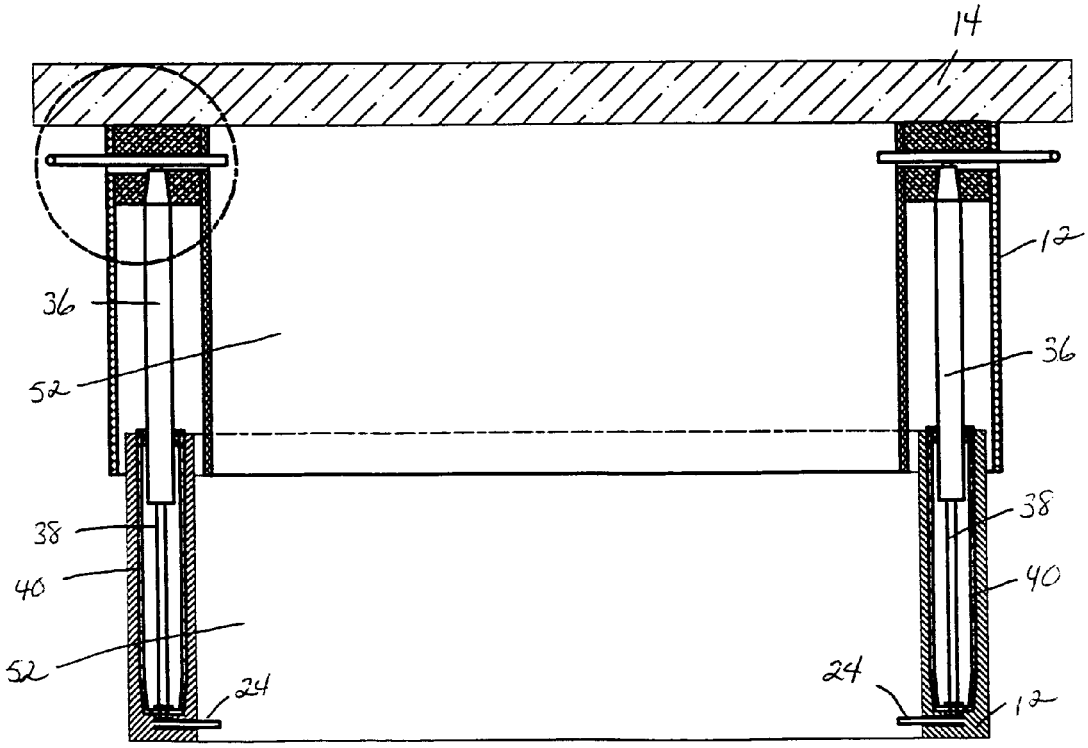
FIG. 19B shows a side elevational view of the embodiment of the table shown in FIG. 19A.
Figure 20:
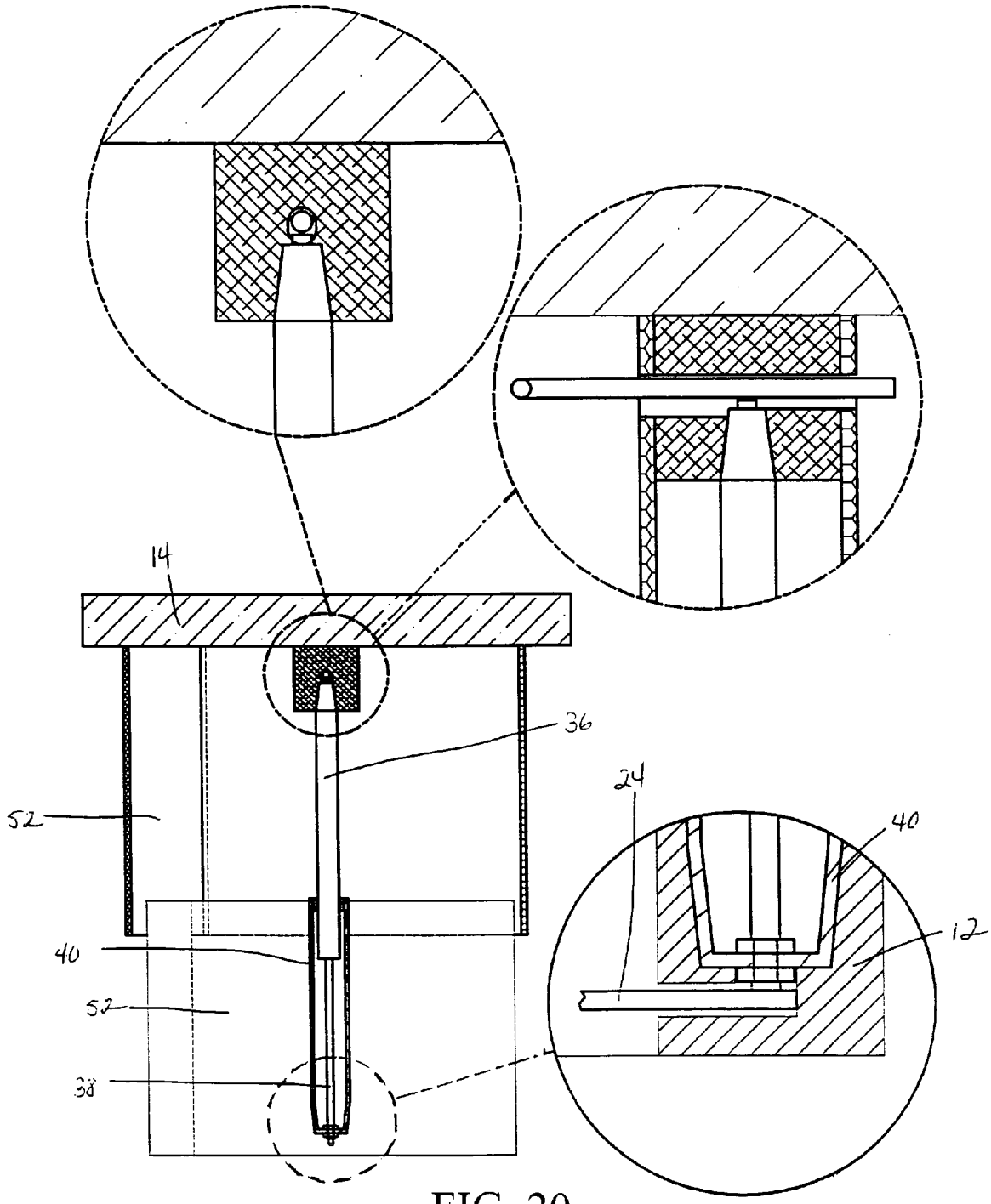
FIG. 20 shows a side elevational view of the embodiment of the table shown in FIG. 19A highlighting the quick release/gas spring actuation mechanisms.

Another preferred embodiment of the tables of the subject invention is shown in FIGS. 19A and B, and FIG. 20. In this embodiment, the continuous U-shaped frame members have panels 52 extending therefrom. Modesty panels 52 provide that one seated at the table is hidden from view from the waist down. Each frame member 12 has at least two tapered sockets 16 to receive table legs 18. In this embodiment, the table legs are gas springs. A continuous U-shaped frame member 12 serves as a table base. The tapered sockets in the base receive the stand tube 40 of the gas spring legs. The stand tubes can be easily dislodged from the base with a single fulcrum quick release mechanism by moving lever 24. A continuous U-shaped frame member 12 likewise serves as a table top support for a table top 14. The table top support has modesty panels 52 and two tapered sockets to receive the cylinders 36 of the gas spring legs. The legs 18 are easily released from the tapered sockets using a combination quick release mechanism/gas spring actuation mechanism shown in detail in FIG. 20. The mechanism shown in FIG. 20 is like that shown in FIGS. 15A–15C. Pulling the lever 48 up will actuate the gas spring. Depressing the lever will likewise actuate the gas spring, but can further dislodge the cylinder from the tapered socket by pressing on the end of the gas spring.

Figure 21A:
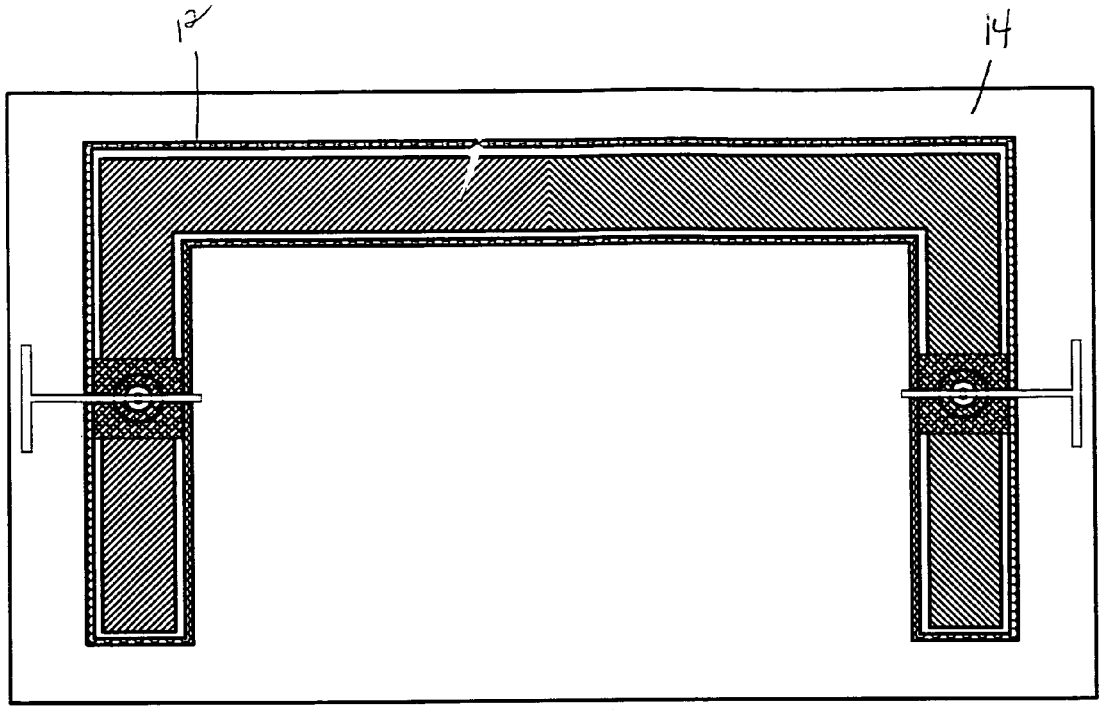
FIG. 21A shows a top plan view of an alternative embodiment of the easily assembled and disassembled tables of the subject invention.
Figure 21B:
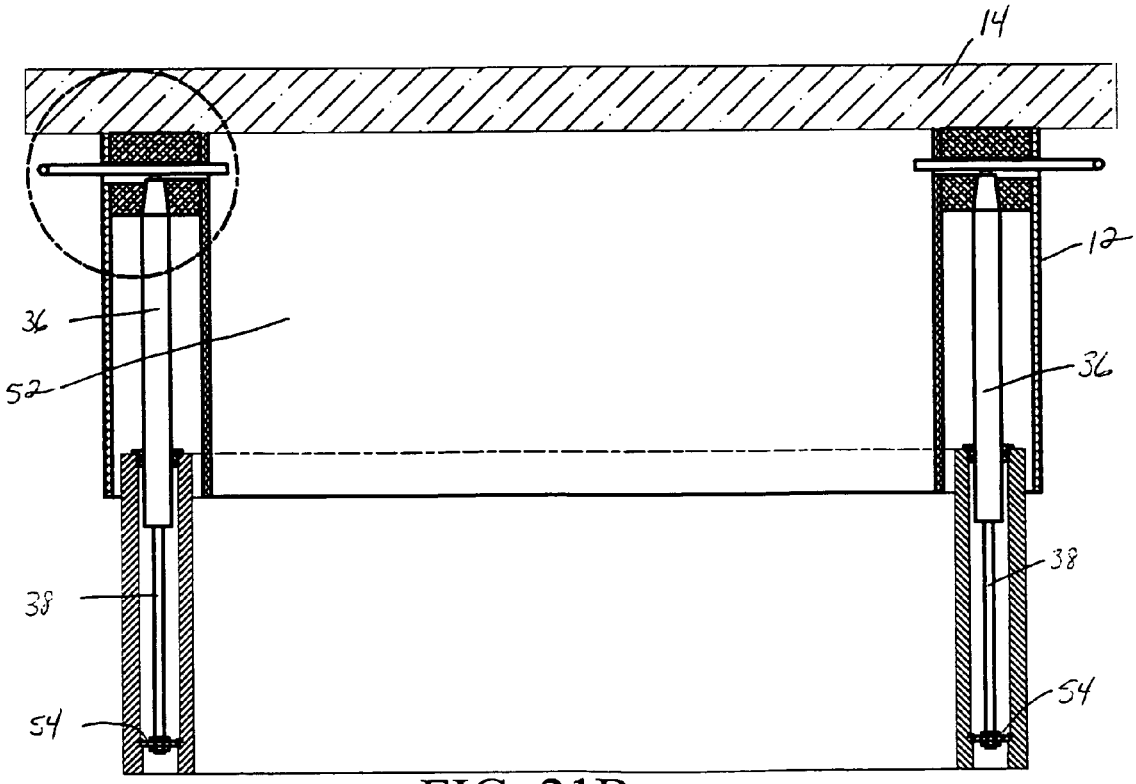
FIG. 21B shows a side elevational view of the embodiment of the table shown in FIG. 21A.
Figure 22:
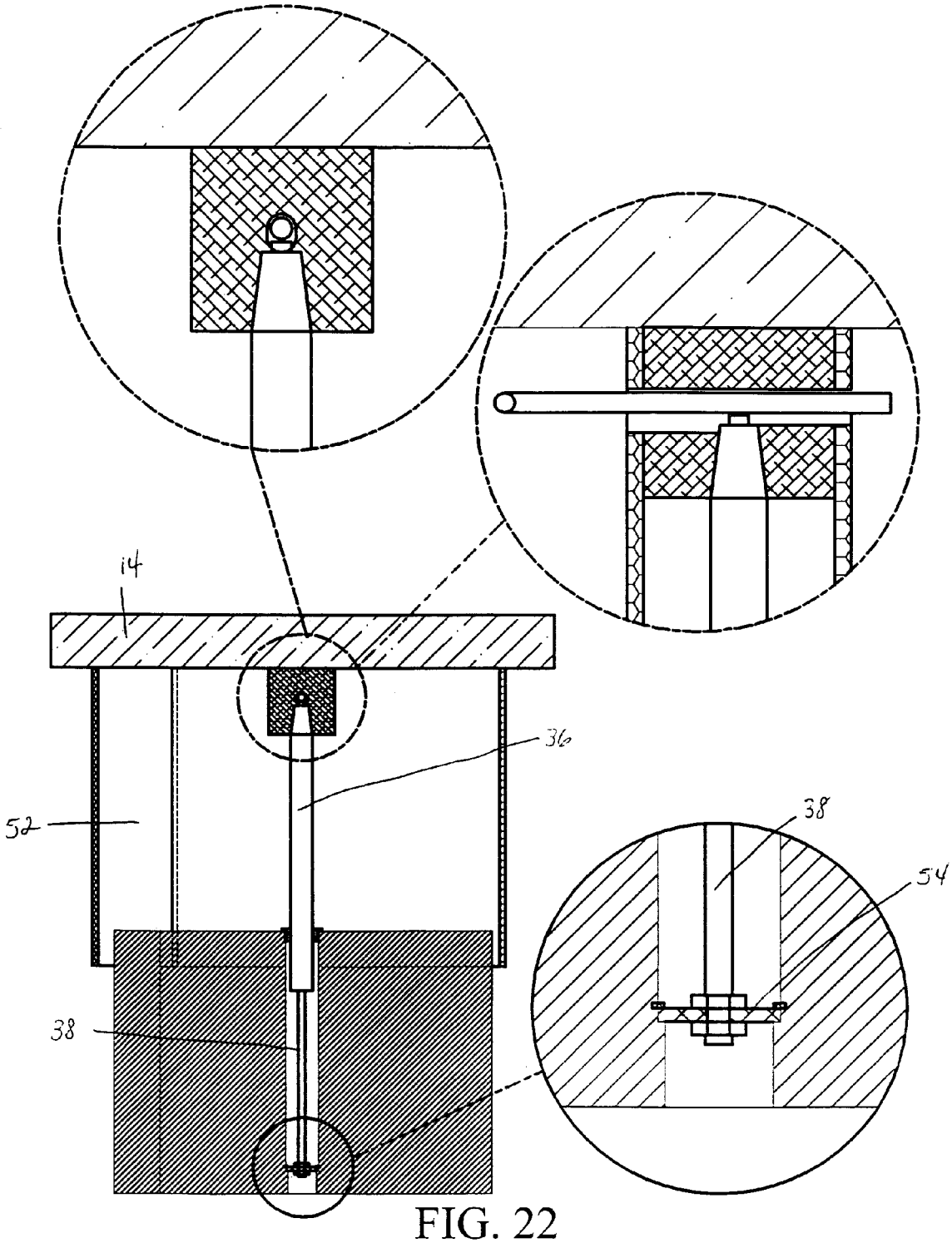
FIG. 22 shows a side elevational view of the embodiment of the table shown in FIG. 21A highlighting the quick release/gas spring actuation mechanisms.

FIGS. 21A and 21B and FIG. 22 show an alternative embodiment of the table of the subject invention where one continuous frame member 12 is used as a table top support to support a table top 14. Gas spring legs are fastened directly to a table base, for example, by bolting or clipping the piston of the gas spring to a fastening plate 54 in the base. The gas springs can be actuated and/or released from the self-locking sockets of the frame member 12 using any of the quick release mechanism described previously.

It is understood that the foregoing examples are merely illustrative of the present invention. Certain modifications of the articles and/or methods employed may be made and still achieve the objectives of the inventions. Such modifications are contemplated as within the scope of the claimed invention.

What is claimed is:

1. An easily assembled and disassembled furniture unit comprising:

a base; a furniture component support; wherein said base comprises an upward facing socket; an upwardly extending furniture support member disposed above said base and supported by said base; wherein said upwardly extending furniture support member comprises an upper end and a lower end; wherein said lower end can be inserted in said upward facing socket; wherein said furniture component support is disposed above and supported by said upwardly extending furniture support member;

a first quick release mechanism comprising means for moving said lower end and said base away from each other when said lower end is inserted in said upward facing socket; wherein when inserted in said upward facing socket, said means comprise at least one furniture support member pressing surface disposed on said upwardly extending furniture support member opposite a base pressing surface; at least one base pressing surface disposed on said base opposite at least one said furniture support member pressing surface; a movable pressing member which can be disposed between said oppositely disposed furniture support member and base pressing surfaces; and wherein said movable pressing member can contact at least one said oppositely disposed base and furniture support member pressing surfaces;

wherein a person can contact and move said movable pressing member from a first position where said movable pressing member merely contacts said oppositely disposed base and furniture support member pressing surfaces, to a second position where said oppositely disposed base and furniture support member pressing surfaces are moved away from each other, resulting in moving said upwardly extending furniture support member and said base away from each other, wherein said upwardly extending furniture support member and said base can be disassembled.

2. The easily assembled and disassembled furniture unit of claim 1, wherein said furniture component support comprises a downward facing socket, wherein said upper end can be inserted in said downward facing socket.

3. The easily assembled and disassembled furniture unit of claim 2, wherein said furniture component support comprises a second quick release mechanism;

wherein said second quick release mechanism comprises means for moving said upper end and said furniture component support away from each other when said upper end comprising said upwardly extending furniture support member is inserted in said downward facing socket comprising said furniture component support; wherein when inserted in said downward facing socket, said means comprise at least one furniture support member pressing surface disposed on said upwardly extending furniture support member opposite at least one furniture component support pressing surface; at least one furniture component support pressing surface disposed on said furniture component support opposite at least one said furniture support member pressing surface; a movable pressing member which can be disposed between said oppositely disposed furniture support member and furniture component support pressing surfaces; and wherein said movable pressing member can contact at least one said oppositely disposed furniture component support and furniture support member pressing surfaces;

wherein a person can contact and move said movable pressing member from a first position where said movable pressing member merely contacts said at least one oppositely disposed furniture component support and furniture support member pressing surfaces, to a second position where said at least one oppositely disposed furniture component support and furniture support member pressing surfaces are moved away from each other, resulting in moving said upwardly extending furniture support member and said furniture component support away from each other, wherein said upwardly extending furniture support member and said furniture component support can be disassembled.

4. The easily assembled and disassembled pedestal furniture unit of claim 1, wherein said means comprises two base pressing surfaces disposed opposite at least one furniture support member surface.

5. The easily assembled and disassembled pedestal furniture unit of claim 1, wherein said base comprises at least one upwardly extending member; wherein said upwardly extending member comprises at least one upward facing socket.

6. The easily assembled and disassembled pedestal furniture unit of claim 1 wherein said furniture component support comprises at least one downwardly extending member; wherein said downwardly extending member comprises at least one downward facing socket.

7. The easily assembled and disassembled pedestal furniture unit of claim 1, wherein said furniture component support comprises a furniture component.

8. The easily assembled and disassembled pedestal furniture unit of claim 7, wherein said furniture component comprises a table top.

9. The easily assembled and disassembled pedestal furniture unit of claim 7, wherein said furniture component comprises a chair seat.

10. The easily assembled and disassembled pedestal furniture unit of claim 1, including a furniture component disposed above and supported by said furniture component support.

11. The easily assembled and disassembled furniture unit of claim 10, wherein said furniture component comprises a table top.

12. The easily assembled and disassembled furniture unit of claim 10, wherein said furniture component comprises a chair seat.

13. The easily assembled and disassembled furniture unit of claim 1, wherein said upper end comprising said upwardly extending furniture support member can move upwardly and downwardly relative to said lower end; wherein said furniture component support can move toward and away from said base.

14. The easily assembled and disassembled pedestal furniture unit of claim 13, further comprises power means for moving said furniture component support relative to said base in at least one direction.

15. An easily assembled and disassembled furniture unit comprising:

a base; a furniture component support; wherein said furniture component support comprises a downward facing socket; an upwardly extending furniture support member comprising an upper and a lower end; wherein said upwardly extending furniture support member is disposed above and supported by said base; wherein said upper end can be inserted in said downward facing socket; wherein said furniture component support is disposed above and supported by said upwardly extending furniture support member; a quick release mechanism comprising means for moving said upper end and said furniture component support away from each other when said upper end is inserted in said downward facing socket; wherein when inserted in said downward facing socket, said means comprise at least one furniture support member pressing surface disposed on said upwardly extending furniture support member opposite a furniture component support pressing surface; at least one furniture component support pressing surface disposed on said furniture component support opposite at least one said furniture support member pressing surface; a movable pressing member which can be disposed between said oppositely disposed furniture support member and furniture component support pressing surfaces; and wherein said moveable pressing member can contact at least one said oppositely disposed furniture component support and furniture support member pressing surfaces;

wherein a person can contact and move said movable pressing member from a first position wherein said movable pressing member merely contacts said oppositely disposed furniture component support and furniture support member pressing surfaces, to a second position wherein said oppositely disposed furniture component support and furniture support member pressing surfaces are moved away from each other, resulting in moving said upwardly extending furniture support member and said furniture component support away from each other, wherein said upwardly extending furniture support member and said furniture component support can be disassembled.

16. The easily assembled and disassembled furniture unit of claim 15, including a furniture component disposed above and supported by said furniture component support.

17. The easily assembled and disassembled furniture unit of claim 16, wherein said furniture component comprises a table top.

18. The easily assembled and disassembled furniture unit of claim 16, wherein said furniture component comprises a chair seat.

19. The easily assembled furniture unit of claim 15, wherein said furniture component support comprises a furniture component.

* * * * *